US008725046B2

(12) United States Patent
Okamoto et al.

(10) Patent No.: US 8,725,046 B2
(45) Date of Patent: May 13, 2014

(54) TRANSFER DEVICE AND IMAGE FORMING APPARATUS

(71) Applicant: Fuji Xerox Co., Ltd., Tokyo (JP)

(72) Inventors: Tetsuji Okamoto, Kanagawa (JP); Masahiro Sato, Kanagawa (JP); Atsushi Ogihara, Kanagawa (JP); Wataru Suzuki, Kanagawa (JP); Koichi Watanabe, Kanagawa (JP); Shuichi Nishide, Kanagawa (JP); Atsuyuki Kitamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 25 days.

(21) Appl. No.: 13/646,185

(22) Filed: Oct. 5, 2012

(65) Prior Publication Data

US 2013/0230343 A1 Sep. 5, 2013

(30) Foreign Application Priority Data

Mar. 5, 2012 (JP) ..... 2012-048265

(51) Int. Cl.
*G03G 15/01* (2006.01)

(52) U.S. Cl.
USPC ..... 399/304; 399/397

(58) Field of Classification Search
CPC .... B65G 29/06; B65G 29/56; G03G 15/6532; G03G 15/1665
USPC ..... 399/304; 101/410
See application file for complete search history.

(56) References Cited

U.S. PATENT DOCUMENTS

| | | | | | |
|---|---|---|---|---|---|
| 4,475,459 | A * | 10/1984 | Wanke et al. | ..... | 101/410 |
| 4,813,353 | A * | 3/1989 | Raab et al. | ..... | 101/410 |
| 5,151,745 | A * | 9/1992 | Durland et al. | ..... | 399/304 |
| 5,253,583 | A * | 10/1993 | Yamamoto et al. | ..... | 101/409 |
| 7,628,109 | B2 * | 12/2009 | Feygelman et al. | ..... | 101/409 |
| 8,509,662 | B2 * | 8/2013 | Tanaka et al. | ..... | 399/304 |
| 2010/0272480 | A1 * | 10/2010 | Kamijo et al. | ..... | 399/304 |

FOREIGN PATENT DOCUMENTS

| | | |
|---|---|---|
| JP | 05-173431 A | 7/1993 |
| JP | 07-225518 A | 8/1995 |

* cited by examiner

*Primary Examiner* — Clayton E Laballe
*Assistant Examiner* — Leon W Rhodes, Jr.
(74) *Attorney, Agent, or Firm* — Sughrue Mion, PLLC

(57) ABSTRACT

A transfer device includes a transfer body that transports a recording medium to a transfer position to transfer toner images to the recording medium; a leading-end gripping member that grips a leading-end portion of the recording medium when causing the recording medium to be wrapped around the transfer body and releases the leading-end portion when causing the recording medium that has been wrapped around the transfer body to become separated from the transfer body; and a moving member that moves, after a final toner image starts being transferred to the recording medium but before the leading-end gripping member releases the leading-end portion, the leading-end gripping member while the leading-end gripping member grips the leading-end portion in order to cause a leading-end side of the recording medium to become separated from the transfer body.

5 Claims, 17 Drawing Sheets

TRANSFER DEVICE AND IMAGE FORMING APPARATUS

CROSS-REFERENCE TO RELATED APPLICATIONS

This application is based on and claims priority under 35 USC 119 from Japanese Patent Application No. 2012-048265 filed Mar. 5, 2012.

BACKGROUND

The present invention relates to transfer devices and image forming apparatuses.

SUMMARY

According to an aspect of the invention, a transfer device includes a transfer body around whose outer circumferential surface a recording medium is wrapped, the transfer body transporting the recording medium to a transfer position, at which the transfer body faces an image carrier on whose surface toner images are sequentially formed while the image carrier rotates, multiple times in order to sequentially transfer the toner images formed on the surface of the image carrier to the recording medium; a leading-end gripping member that is disposed at a recess formed in the outer circumferential surface of the transfer body, the leading-end gripping member gripping a leading-end portion of the recording medium when causing the recording medium to be wrapped around the transfer body, the leading-end gripping member releasing the leading-end portion of the recording medium when causing the recording medium that has been wrapped around the transfer body to become separated from the transfer body; and a moving member that moves, after a final toner image starts being transferred to the recording medium but before the leading-end gripping member releases the leading-end portion of the recording medium, the leading-end gripping member while the leading-end gripping member grips the leading-end portion of the recording medium in order to cause a leading-end side of the recording medium to become separated from the outer circumferential surface of the transfer body.

BRIEF DESCRIPTION OF THE DRAWINGS

Exemplary embodiments of the present invention will be described in detail based on the following figures, wherein.

DETAILED DESCRIPTION

First Exemplary Embodiment

A transfer device 14 and an image forming apparatus 10 according to a first exemplary embodiment of the present invention will be described referring to FIGS. 1 to 11.

Entire Configuration

Figure 11:
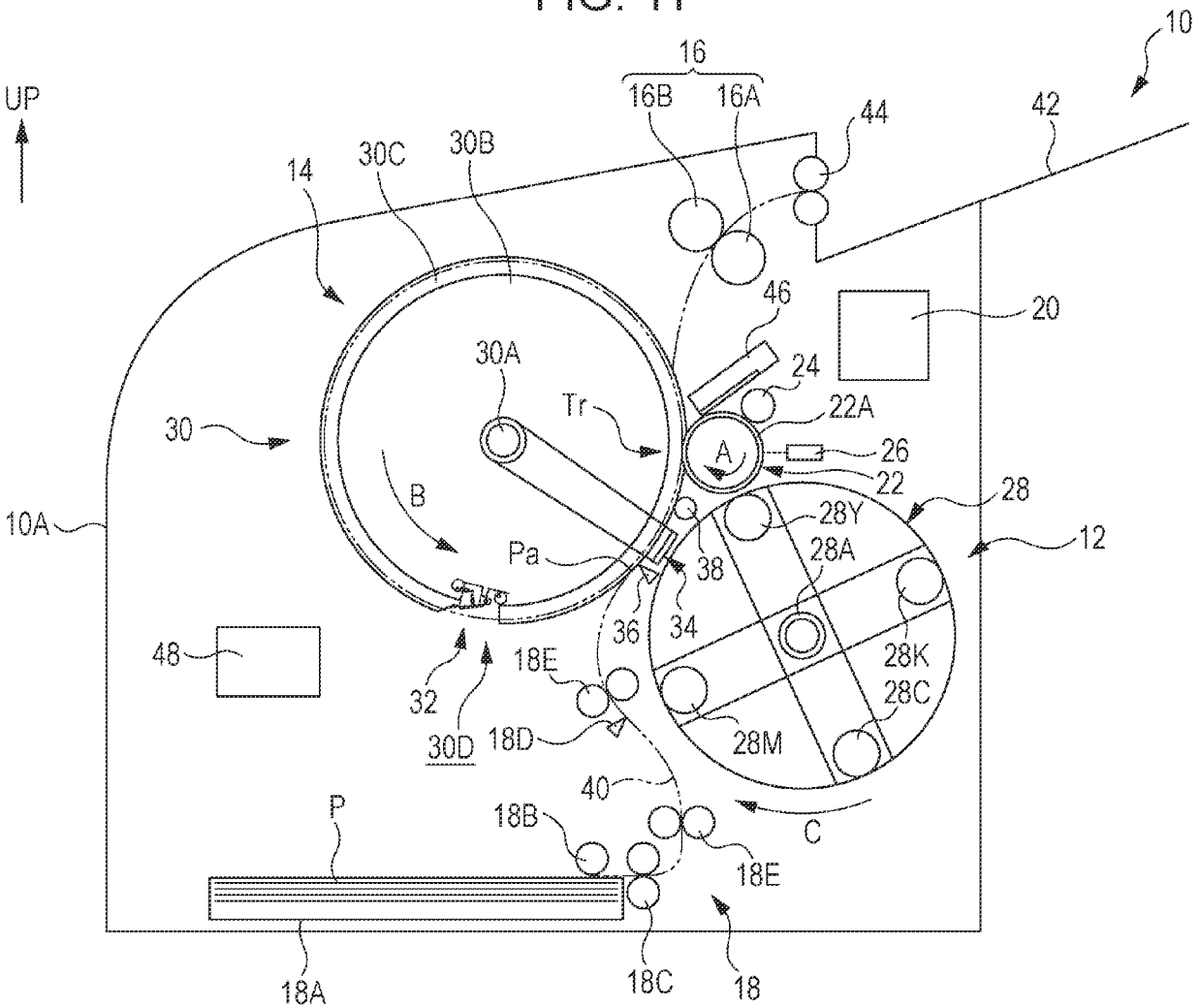
FIG. 11 schematically illustrates the image forming apparatus according to the first exemplary embodiment.

As illustrated in FIG. 11, the image forming apparatus 10 according to the first exemplary embodiment of the present invention includes an image forming unit 12, a transfer device 14, a fixing device 16, a sheet feeding unit 18, and a controller 20. The image forming unit 12 forms a toner image. A sheet medium P is a recording medium and is fed to the transfer device 14, and the transfer device 14 transfers the toner image, having been formed by the image forming unit 12, to the sheet medium P that is wrapped around the transfer device 14. The fixing device 16 fixes the toner image, having been formed on the sheet medium P released from the transfer device 14, onto the sheet medium P. The sheet feeding unit 18 feeds the sheet medium P to the transfer device 14. The controller 20 controls the entirety of the image forming apparatus 10.

Image Forming Unit

The image forming unit 12 that forms a toner image will be described first.

The image forming unit 12 includes an image carrier 22, on whose surface toner images are sequentially formed while the image carrier 22 is rotating. The image forming unit 12 also includes a charging device 24, an exposing device 26, a rotary developing device 28, and a cleaning device 46. The charging device 24 charges the surface of the image carrier 22. The exposing device 26 exposes the charged surface of the image carrier 22 to light to form an electrostatic latent image. The rotary developing device 28 develops the electrostatic latent image, having been formed on the surface of the image carrier 22, by using a developer into a toner image. The cleaning device 46 removes remnants remaining on the image carrier 22.

Image Carrier

The image carrier 22 is disposed so as to rotate in the arrow A direction and includes a negatively charged photosensitive layer 22A on the surface. The charging device 24, the exposing device 26, the rotary developing device 28, and the cleaning device 46 are arranged around the image carrier 22 in this order in the arrow A direction.

The image carrier 22 also includes a driving motor 22B (see FIG. 10), which is an example of a driving member, that drives the image carrier 22 to rotate at a peripheral velocity V1.

Charging Device

The charging device 24 is arranged so as to face the image carrier 22. While the charging device 24 is driven to rotate by the rotating image carrier 22, the charging device 24 charges the surface of the image carrier 22.

Exposing Device

The exposing device 26 irradiates the surface of the image carrier 22 having been charged by the charging device 24 with light to form an electrostatic latent image. In this exemplary embodiment, the exposing device 26 includes, for example, multiple light emitting diodes (LEDs, which are not illustrated).

Rotary Developing Device

The rotary developing device 28 includes a rotation shaft 28A and developing portions 28Y, 28M, 28C, and 28K for yellow (Y), magenta (M), cyan (C), and black (K) arranged around the rotation shaft 28A. The rotary developing device 28 rotates in the arrow C direction around the rotation shaft 28A.

In the rotary developing device 28, each of the developing portions 28Y, 28M, 28C, and 28K is positioned at a position opposite the image carrier 22. The rotary developing device 28 then sequentially develops the electrostatic latent images having been formed on the image carrier 22 by the exposing device 26 into toner images of the different colors.

These developing portions 28Y, 28M, 28C, and 28K contain developers of corresponding colors.

Cleaning Device

The cleaning device 46 recovers toner remaining on the surface of the image carrier 22 without being transferred to the sheet medium P by the transfer device 14, which will be described below, or other extraneous matters from the surface of the image carrier 22. The cleaning device 46 according to the exemplary embodiment is a blade-type cleaner.

Transfer Device

Now, description will be given on the transfer device 14 around which a sheet medium P is wrapped and that transfers a toner image having been formed by the image forming unit 12 to the wrapped sheet medium P.

The transfer device 14 includes a transfer drum 30, a leading-end gripper 32, and a trailing-end gripper 34. The transfer drum 30 is taken as an example of a transfer body around which a sheet medium P, to which a toner image on the image carrier 22 is transferred, is wrapped. The leading-end gripper 32 is taken as an example of a leading-end gripping member that grips a leading-end portion of the sheet medium P wrapped around the transfer drum 30. The trailing-end gripper 34 restricts the position of a trailing-end portion of the sheet medium P.

The transfer device 14 also includes a sheet sensor 36 that detects a sheet medium P passing thereby, a pressing roller 38 that presses a sheet medium P against the transfer drum 30, a driving motor M1 (see FIGS. 7A and 7B) that drives the transfer drum 30 to rotate, and a power source 48 that applies a transfer bias, which is a voltage of a polarity opposite to that of the toner, to the transfer drum 30.

Transfer Drum

The transfer drum 30 arranged so as to face the image carrier 22 includes a rotation shaft 30A, a drum-shaped base portion 30B, and an elastically deformable elastic layer 30C that is formed around the outer circumferential surface of the base portion 30B.

The elastic layer 30C, from a leading end to a trailing end of the elastic layer 30C in a direction in which the sheet medium P is transported, follows the shape the outer circumference of the drum-shaped base portion 30B. A portion of the transfer drum 30 around which even a maximum-size sheet medium P is not wrapped is a cutout region 30D, which is an example of a recess and in which the elastic layer 30C is absent such that a part of the elastic layer 30C in the circumferential direction is cut out.

The dimensions of the transfer drum 30 and the image carrier 22 and the positional relationship between the transfer drum 30 and the image carrier 22 are determined such that the transfer drum 30 and the image carrier 22 do not contact each other when the cutout region 30D of the transfer drum 30 faces the image carrier 22. A dielectric substance, such as a dielectric sheet, is not attached to the outer circumferential surface of the elastic layer 30C, and thus wrapping of a sheet medium P around the transfer drum 30 does not involve the use of electrostatic attraction.

At the transfer position Tr, transporting of the sheet medium P that is nipped by the transfer drum 30 and the image carrier 22 is performed dominantly by using electrostatic attraction of the image carrier 22.

Figure 7A:
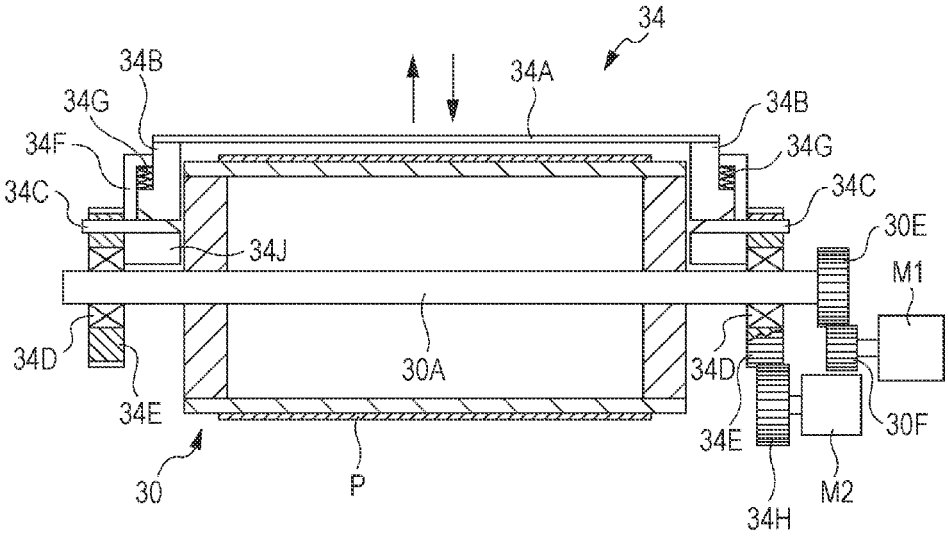
FIGS. 7A and 7B schematically illustrate a configuration of the transfer drum and the trailing-end gripper of the image forming apparatus according to the first exemplary embodiment.
Figure 7B:
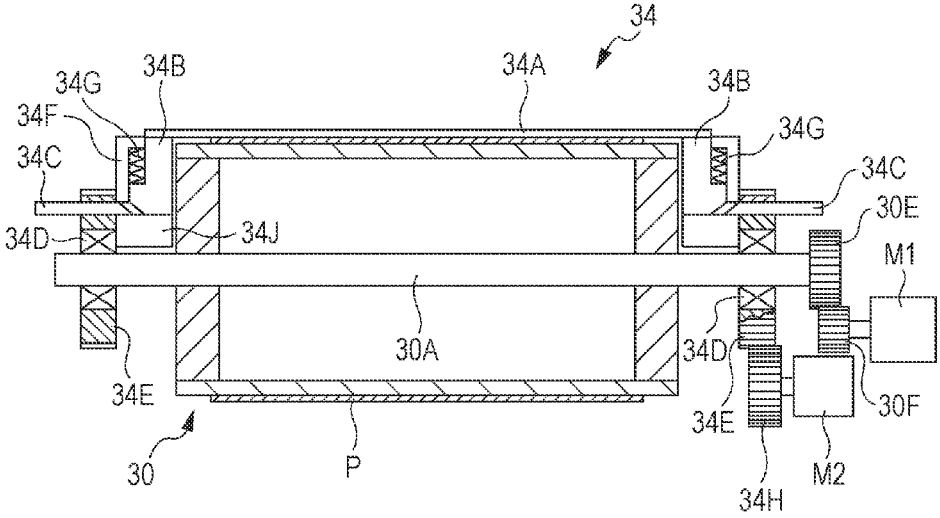

As illustrated in FIGS. 7A and 7B, a gear 30E is mounted on an end portion of the rotation shaft 30A of the transfer drum 30 and meshes with a gear 30F mounted on an output shaft of the driving motor M1, which drives the transfer drum 30 to rotate.

Sheet Sensor

As illustrated in FIG. 11, the sheet sensor 36 is disposed so as to face the outer circumferential surface of the transfer drum 30. The sheet sensor 36 irradiates the sheet medium P, which is transported while being wrapped around the transfer drum 30, with infrared light, and detects the sheet medium P passing thereby using the reflected light.

The sheet sensor 36 is disposed upstream from a stand-by position of the trailing-end gripper 34 (the position of the trailing-end gripper 34 illustrated in FIG. 11), which will be described in detail below, and downstream from a feeding-sheet position Pa at which a sheet medium P is fed to the transfer drum 30, in the direction in which the sheet medium P is transported.

Pressing Roller

The pressing roller 38 that presses a sheet medium P against the transfer drum 30 is disposed upstream from a transfer portion Tr and downstream from the stand-by position of the trailing-end gripper 34 in the direction in which the sheet medium P is transported.

Figure 10:
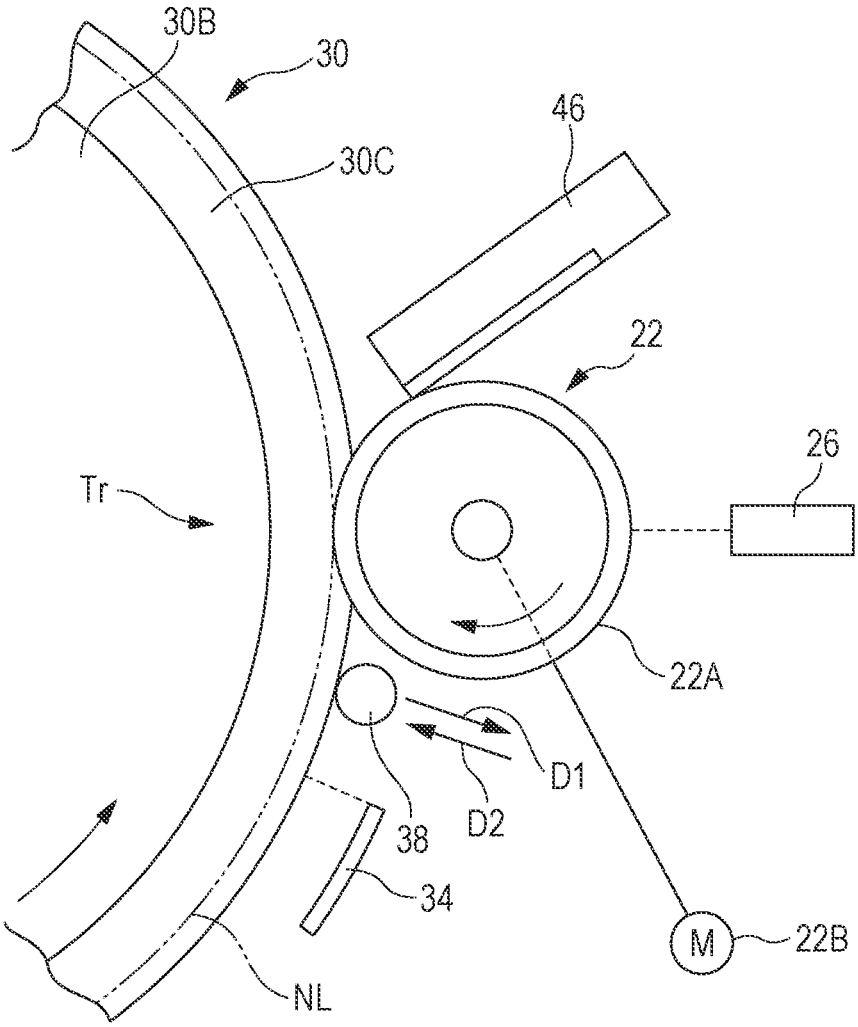
FIG. 10 illustrates the surroundings of a transfer position of the image forming apparatus according to the exemplary embodiment.

The pressing roller 38 moves toward or away from the transfer drum 30 (see the arrows D1 and D2 in FIG. 10).

Leading-End Gripper

Figure 5A:
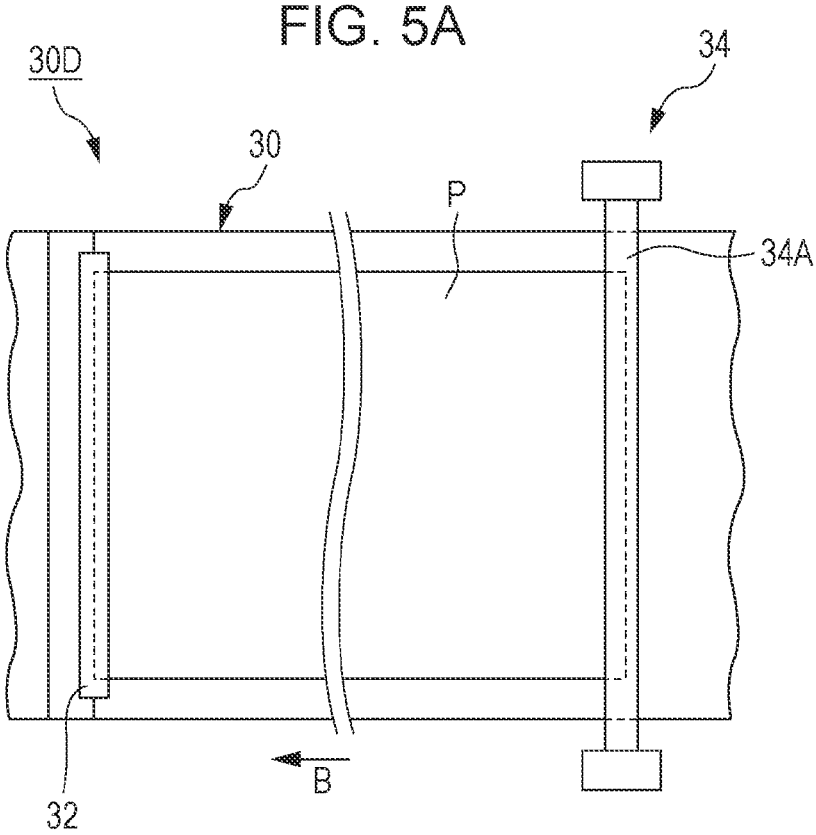
FIG. 5A is a developed view of a transfer drum, the leading-end gripper, and a trailing-end gripper of the image forming apparatus according to the first exemplary embodiment.
Figure 5B:
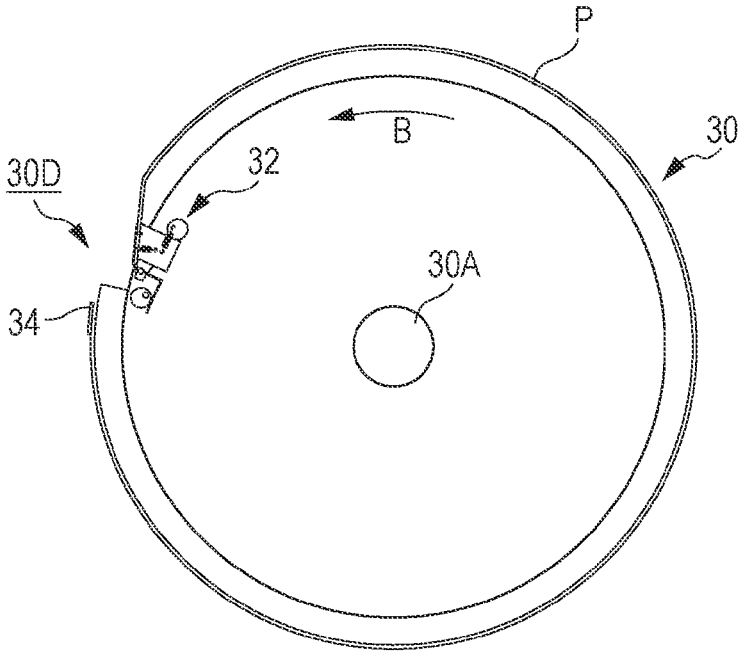
FIG. 5B is a side view of the transfer drum, the leading-end gripper, and the trailing-end gripper.

As illustrated in FIGS. 5A and 5B, the leading-end gripper 32 that grips the leading-end portion of the sheet medium P wrapped around the transfer drum 30 is attached to the transfer drum 30, and is disposed in the cutout region 30D. FIG. 5A is a developed view in which the outer periphery of the transfer drum 30 is developed.

Figure 4A:
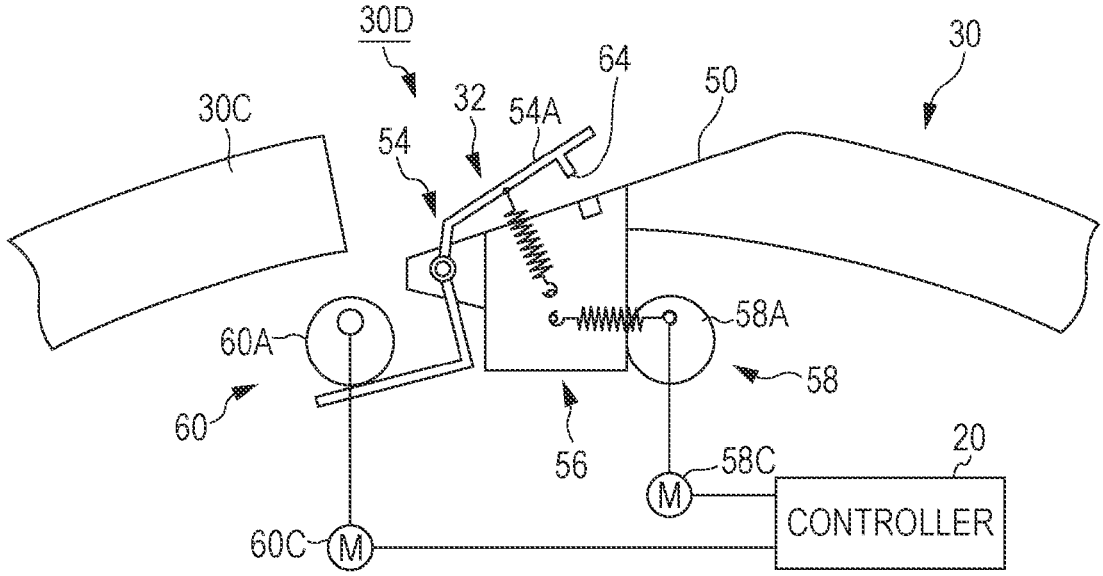
FIGS. 4A and 4B are side views of the leading-end gripper of an image forming apparatus according to the first exemplary embodiment that is in a releasing state and a gripping state.
Figure 4B:
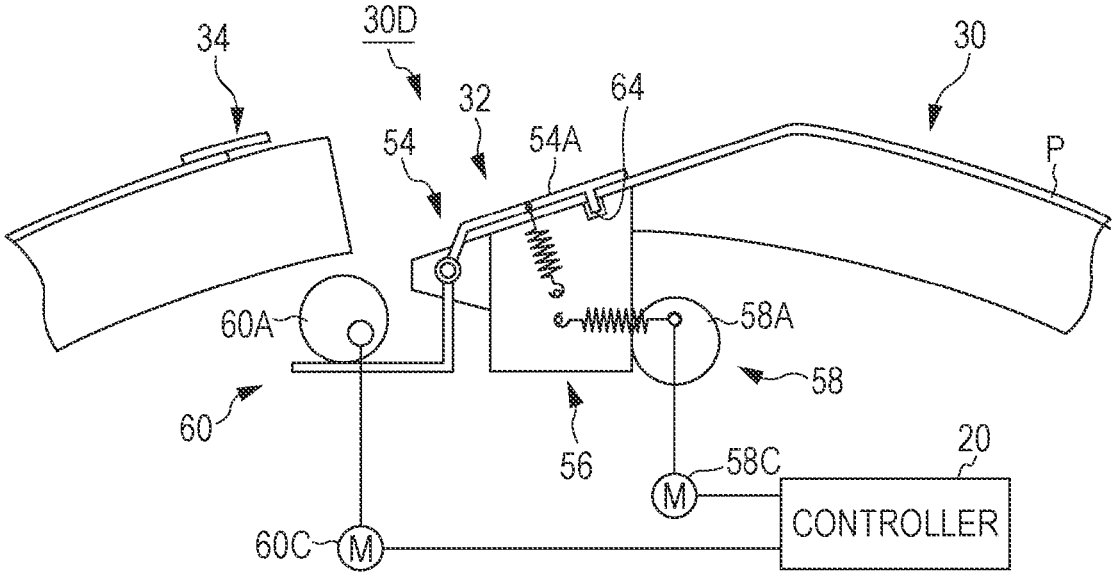

As illustrated in FIGS. 4A and 4B, the leading-end gripper 32 moves so as to switch between a gripping state (see FIG. 4B), in which the leading-end gripper 32 grips the leading-end portion of the sheet medium P, and a releasing state (see FIG. 4A), in which the leading-end gripper 32 releases the leading-end portion of the sheet medium P.

The detail of the leading-end gripper 32 will be described below.

Trailing-End Gripper

As illustrated in FIGS. 5A and 5B, the trailing-end gripper 34 is stretched across the transfer drum 30 in the drum axis direction, and rotates around the rotation shaft 30A independently of the transfer drum 30.

As illustrated in FIGS. 7A and 7B, the trailing-end gripper 34 includes a sheet restricting portion 34A extending in the drum axis direction, and holding portions 34B that hold both end portions of the sheet restricting portion 34A. The sheet restricting portion 34A stops the trailing-end portion of the sheet medium P from moving.

The sheet restricting portion 34A is made of a film-formed resin material and is elastically deformable. Examples of the resin material include polyethylene terephthalate (PET), polyimide, and fluorocarbon resins.

The holding portions 34B extend in the radial direction of the transfer drum 30 (also simply referred to as a "drum radius direction", below). The trailing-end gripper 34 also includes wedge-shaped shifting members 34C, whose movement in the drum axis direction causes the sheet restricting portion 34A to move in the drum radius direction via the holding portions 34B.

Figure 6A:
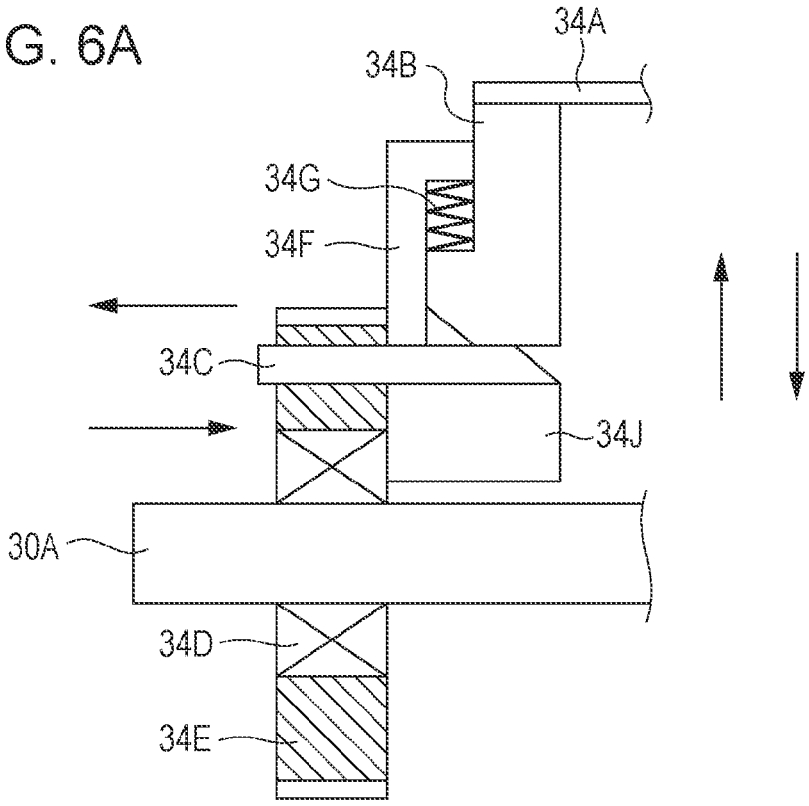
FIGS. 6A and 6B schematically illustrate a configuration of the trailing-end gripper of the image forming apparatus according to the first exemplary embodiment.
Figure 6B:
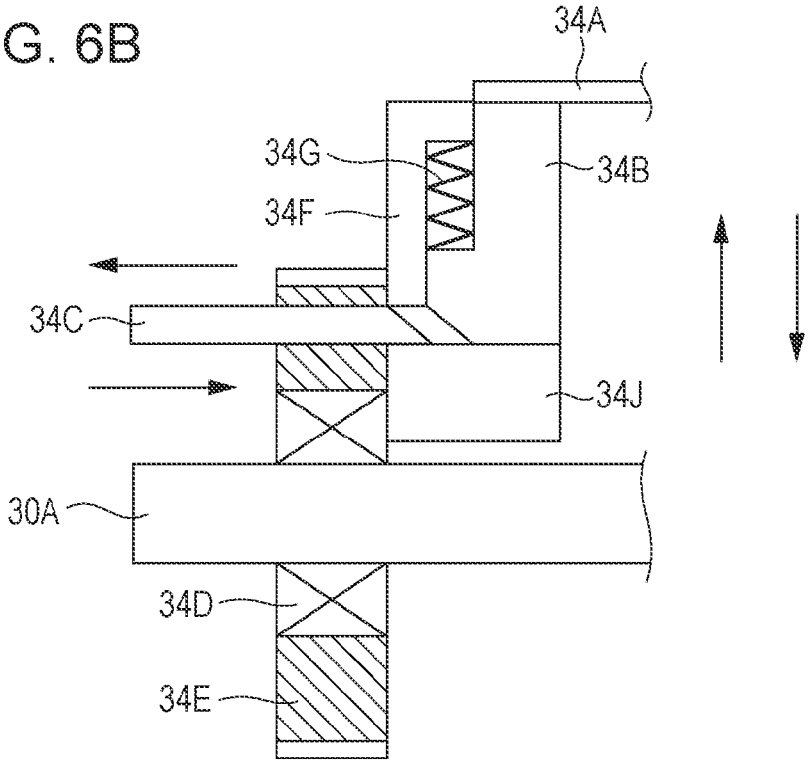

As illustrated in FIGS. 6A and 6B, gears 34E are mounted on the rotation shaft 30A via bearings 34D, and supporting portions 34F extending in the drum radius direction are disposed at the gears 34E. Each holding portion 34B is disposed so as to be movable relative to a corresponding one of the supporting portions 34F in the drum radius direction. A spring member 34G is interposed between each holding portion 34B and a corresponding supporting portion 34F, the spring member 34G urging the holding portion 34B in a radially inward direction. The trailing-end gripper 34 also includes stopper portions 34J that restrict the positions of the holding portions 34B when the holding portions 34B having been urged by the spring members 34G in the radially inward direction abut against the stopper portions 34J.

In this configuration, when the controller 20 controls a solenoid, which is not illustrated, to move the wedge-shaped shifting members 34C in the drum axis direction into spaces between the holding portions 34B and the stopper portions 34J, the holding portions 34B are moved in a radially outward direction. With this operation, the sheet restricting portion 34A switches to the releasing state, in which the sheet restricting portion 34A becomes separated from the elastic layer 30C to release the trailing-end portion of the sheet medium P (see FIGS. 6A and 7A).

On the other hand, when the controller 20 controls a solenoid, which is not illustrated, to move the wedge-shaped shifting members 34C in the drum axis direction and pull out the wedge-shaped shifting members 34C from the spaces between the holding portions 34B and the stopper portions 34J, the holding portions 34B are moved in a radially inward direction. With this operation, the sheet restricting portion 34A switches to the restricting state in which the sheet restricting portion 34A brings the trailing-end portion of the sheet medium P into contact with the elastic layer 30C such that the trailing-end portion becomes flush with the elastic layer 30C (see FIGS. 6B and 7B).

As illustrated in FIGS. 7A and 7B, a driving motor M2 that drives the trailing-end gripper 34 to rotate around the rotation shaft 30A is provided, and a gear 34H that is mounted on an output shaft of the driving motor M2 meshes with one of the gears 34E.

As described above, since the trailing-end gripper 34 is disposed as a body that is separate from the transfer drum 30, the position of the trailing-end gripper 34 relative to the transfer drum 30 is changeable.

When the leading-end gripper 32 grips the leading-end portion of the sheet medium P, the leading-end gripper 32 does not allow the sheet medium P to move in the transporting direction and stops the sheet medium P from moving away from the transfer drum 30. On the other hand, when the trailing-end gripper 34 restricts the trailing-end portion of the sheet medium P, the trailing-end gripper 34 allows the sheet medium P to move in the transporting direction but stops the sheet medium P from moving away from the transfer drum 30.

Fixing Device

The fixing device 16 that fixes a toner image formed on a sheet medium P to the sheet medium P will be described now.

As illustrated in FIG. 11, the fixing device 16 includes a heating roller 16A and a pressurizing roller 16B. The heating roller 16A includes a heating source (not illustrated) and a rotating force is transmitted to the heating roller 16A. The pressurizing roller 16B is brought into contact with the heating roller 16A with pressure.

When a sheet medium P holding a toner image is nipped between and transported by the heating roller 16A and the pressurizing roller 16B, the toner image is melted and pressurized and is thus fixed to the sheet medium P.

Discharging rollers 44 are disposed downstream from the fixing device 16 in the direction in which the sheet medium P is transported. The discharging rollers 44 discharge the sheet medium P, having a toner image fixed thereon, to a discharge portion 42 formed on an upper surface of an apparatus body 10A.

Sheet Feeding Unit

Now, the sheet feeding unit 18 that feeds a sheet medium P to the transfer device 14 will be described.

The sheet feeding unit 18 is disposed at a lower portion in the apparatus body 10A of the image forming apparatus 10 and includes a sheet containing member 18A, a pick-up roller 18B, separation rollers 18C, and a leading-end sensor 18D. The sheet containing member 18A contains sheet media P. The pick-up roller 18B picks up the sheet media P from the sheet containing member 18A. The separation rollers 18C separate closely-attached sheet media P from each other. The leading-end sensor 18D detects the leading-end portion of a sheet medium P passing thereby.

The sheet feeding unit 18 also includes multiple transporting rollers 18E. Each sheet medium P is transported by the transporting rollers 18E along a transport path 40.

In this manner, each sheet medium P is transported along the transport path 40 from the sheet containing member 18A to the feeding-sheet position Pa, which is positioned upstream from the transfer position Tr in the direction of rotation of the transfer drum 30.

Operations of Entire Configuration

Now, operations of the entire configuration will be described.

Firstly, image data that has been formed by a personal computer or the like, which is not illustrated, is input to an image signal processor (not illustrated) as red (R), green (G), and blue (B) data, for example, and is then subjected to image processing. The image data that has been subjected to image processing is converted into four-color gradation data for yellow (Y), magenta (M), cyan (C), and black (K), which is output to the exposing device 26, so that an image forming operation is started.

While the leading-end gripper 32 rotates together with the transfer drum 30, the trailing-end gripper 34 remains stationary at the stand-by position without rotating together with the transfer drum 30 while being in the releasing state.

The photosensitive layer 22A of the rotating image carrier 22 is charged by the charging device 24. The exposing device 26 then irradiates the image carrier 22 with light so that an electrostatic latent image for a first color (yellow, for example) based on the image information is formed on the image carrier 22.

Meanwhile, the rotary developing device 28 rotates so that a developing portion containing a toner of the color corresponding to the electrostatic latent image to be formed on the image carrier 22 (the yellow developing portion 28Y, if the corresponding color is yellow) is positioned at a position opposite the image carrier 22.

Thereafter, the developing portion 28Y develops the electrostatic latent image on the image carrier 22 to form a toner image on the image carrier 22. This toner image is transported toward the transfer position Tr, at which the toner image faces the transfer drum 30, with the rotation of the image carrier 22.

With the start of the image forming operation, feeding of a sheet medium P is also started. Specifically, sheet media P that are picked up from the sheet containing member 18A by the pick-up roller 18B are separated by the separation rollers 18C. The separated sheet media P are forwarded to the transport path 40 by the transporting rollers 18E. The leading-end sensor 18D then detects the leading-end portion of each sheet medium P passing thereby and transmits a detection signal to the controller 20.

Figure 8A:
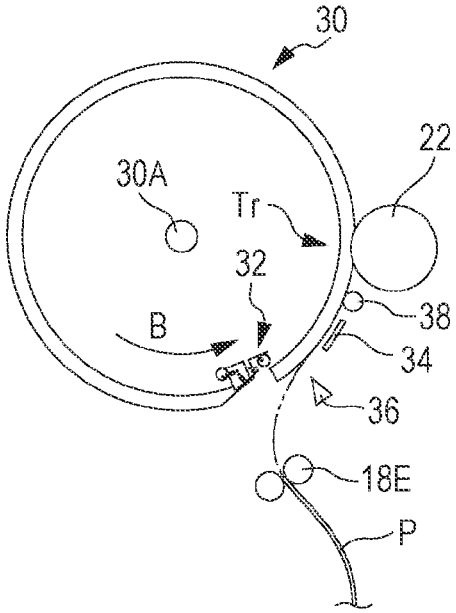
FIGS. 8A to 8D illustrate a series of states in which a sheet medium is wrapped around the transfer drum of the image forming apparatus according to the first exemplary embodiment.

The controller 20 that has received the detection signal controls transportation of the sheet medium P on the basis of the detection signal such that the sheet medium P arrives at the feeding-sheet position Pa at the same time as when the leading-end gripper 32 arrives at the feeding-sheet position Pa (see FIG. 8A).

Here, at the time of feeding the sheet medium P, information on the size of the sheet medium P that has been detected by a sheet-size sensor (not illustrated) is transmitted to the controller 20.

Figure 8B:
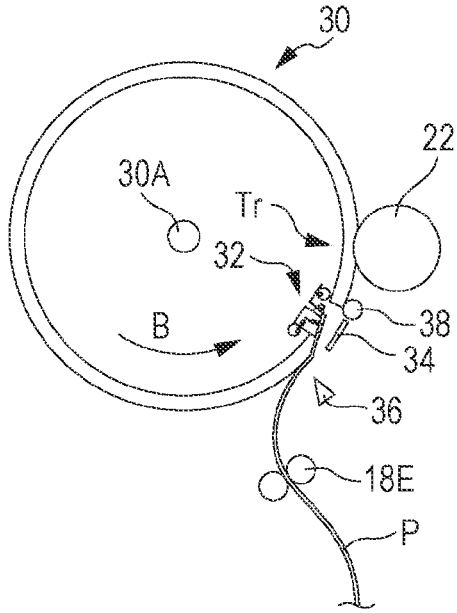

As illustrated in FIG. 8B, the leading-end gripper 32 that has been in the releasing state switches to the gripping state upon arrival of the leading-end portion of the sheet medium P at the feeding-sheet position Pa. The leading-end portion of the sheet medium P is thus gripped by the leading-end gripper 32.

The leading-end gripper 32 gripping the sheet medium P then passes a position opposite the stationary trailing-end gripper 34. The leading-end gripper 32 having passed the trailing-end gripper 34 then moves toward the transfer position Tr while gripping the sheet medium P. Here, the pressing roller 38 is positioned at a contact position, at which the pressing roller 38 contacts the elastic layer 30C, and presses the sheet medium P against the elastic layer 30C such that the sheet medium P is wrapped around the transfer drum 30 so as to become flush with the elastic layer 30C.

Figure 8C:
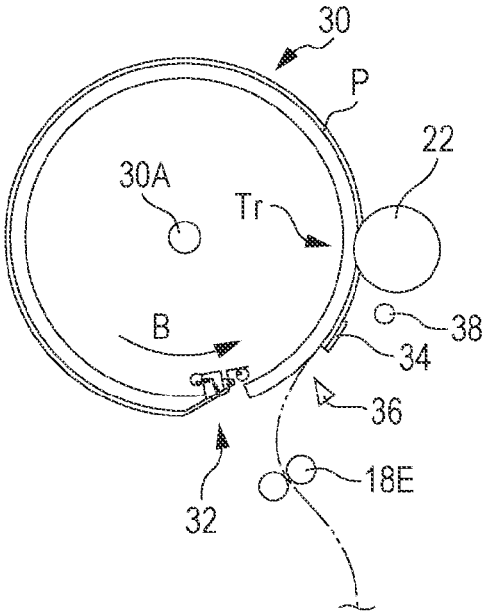

The sheet medium P that has passed the transfer position Tr while being gripped by the leading-end gripper 32 is consequently wrapped around the transfer drum 30 while being gripped by the leading-end gripper 32, as illustrated in FIG. 8C.

The toner image of the first color (yellow, for example) formed on the image carrier 22 is transferred to the sheet medium P on the transfer drum 30 at the transfer position Tr at which the image carrier 22 and the transfer drum 30 face each other. Part of toner remaining on the image carrier 22 after the transfer is recovered from the image carrier 22 by the cleaning device 46 (see FIG. 10).

Thereafter, the sheet sensor 36 detects the trailing-end portion of the sheet medium P passing thereby. The controller 20 that has received a signal from the sheet sensor 36 sends an instruction to the trailing-end gripper 34 and the pressing roller 38.

The trailing-end gripper 34 having received the instruction switches from the releasing state to the restricting state to restrict the trailing-end portion of the sheet medium P. The pressing roller 38 having received the instruction moves from the contact position to a separation position to be separated from the sheet medium P.

The trailing-end gripper 34 that has switched to the restricting state starts rotating together with the transfer drum 30. In other words, the sheet restricting portion 34A of the trailing-end gripper 34 moves at the same velocity as the peripheral velocity V2 of the transfer drum 30.

Figure 8D:
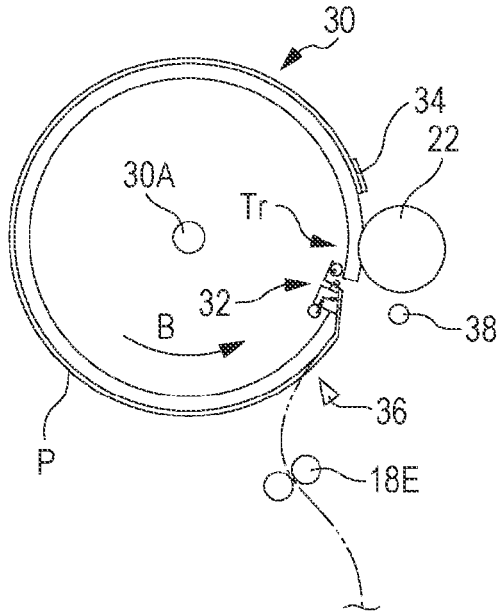

As illustrated in FIG. 8D, the trailing-end gripper 34 rotating together with the transfer drum 30 passes the transfer position Tr while restricting the trailing-end portion of the sheet medium P.

Likewise, forming and developing of latent images for second and subsequent colors (magenta and cyan, for example), which precede a final color (black, for example), and transferring of toner images corresponding to the latent images is repeated in accordance with the above-described procedure.

Figure 9A:
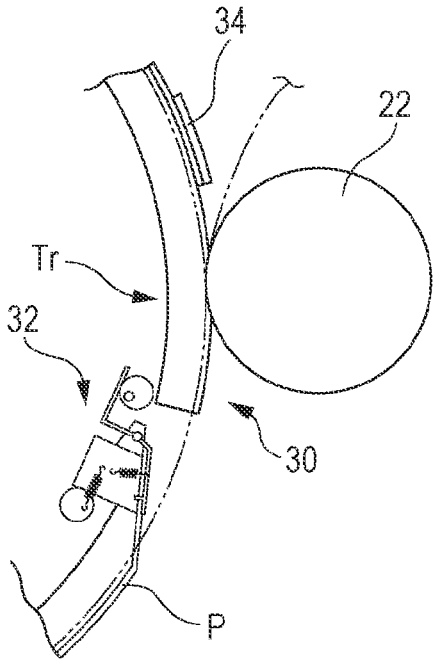
FIGS. 9A to 9D illustrate a series of states in which a sheet medium that has been wrapped around the transfer drum of the image forming apparatus according to the first exemplary embodiment is separated from the transfer drum.
Figure 9B:
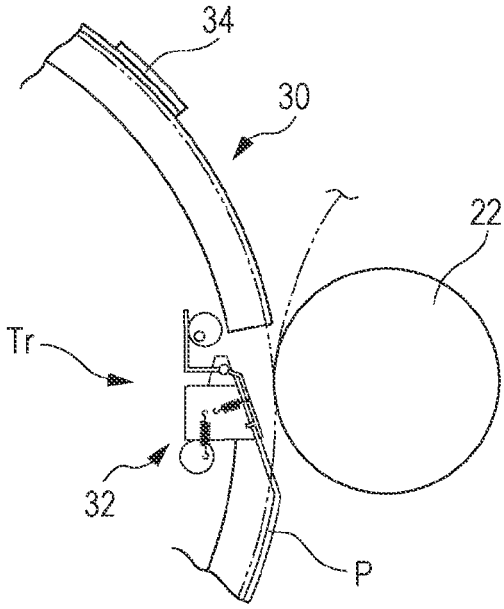
Figure 9C:
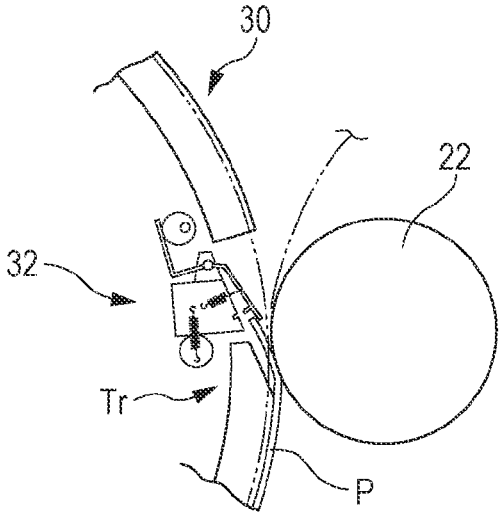

As illustrated in FIGS. 9A, 9B, and 9C, in the case of transferring a toner image of a final color (black, for example), the leading-end gripper 32 switches from the gripping state to the releasing state at the transfer position Tr, unlike in the case of transferring a toner image of a color that precedes the final color.

Figure 9D:
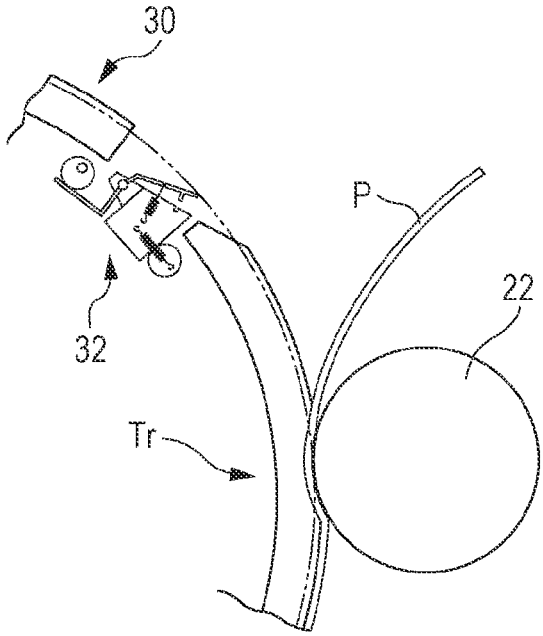

As illustrated in FIGS. 9C and 9D, when the leading-end gripper 32 releases the leading-end portion of the sheet medium P on which multiple toner images are formed, a leading-end side of the sheet medium P becomes separated from the transfer drum 30.

The sheet medium P whose leading-end side is separated from the transfer drum 30 is transported toward the fixing device 16 illustrated in FIG. 11.

As the sheet medium P is transported further, the trailing-end gripper 34 that restricts the trailing-end portion of the sheet medium P arrives at the stand-by position. At the stand-by position, the trailing-end gripper 34 switches from the restricting state to the releasing state to release the trailing-end portion of the sheet medium P. The trailing-end gripper 34 that has switched to the releasing state stops at the stand-by position.

The toner images on the sheet medium P having been transported to the fixing device 16 are fixed to the sheet medium P by the fixing device 16. As the sheet medium P is transported further, the sheet medium P becomes separated from the transfer drum 30. The sheet medium P is finally discharged to the discharge portion 42 by the discharging rollers 44.

Configuration of Related Portions

The leading-end gripper 32 and other components are described now.

Figure 1:
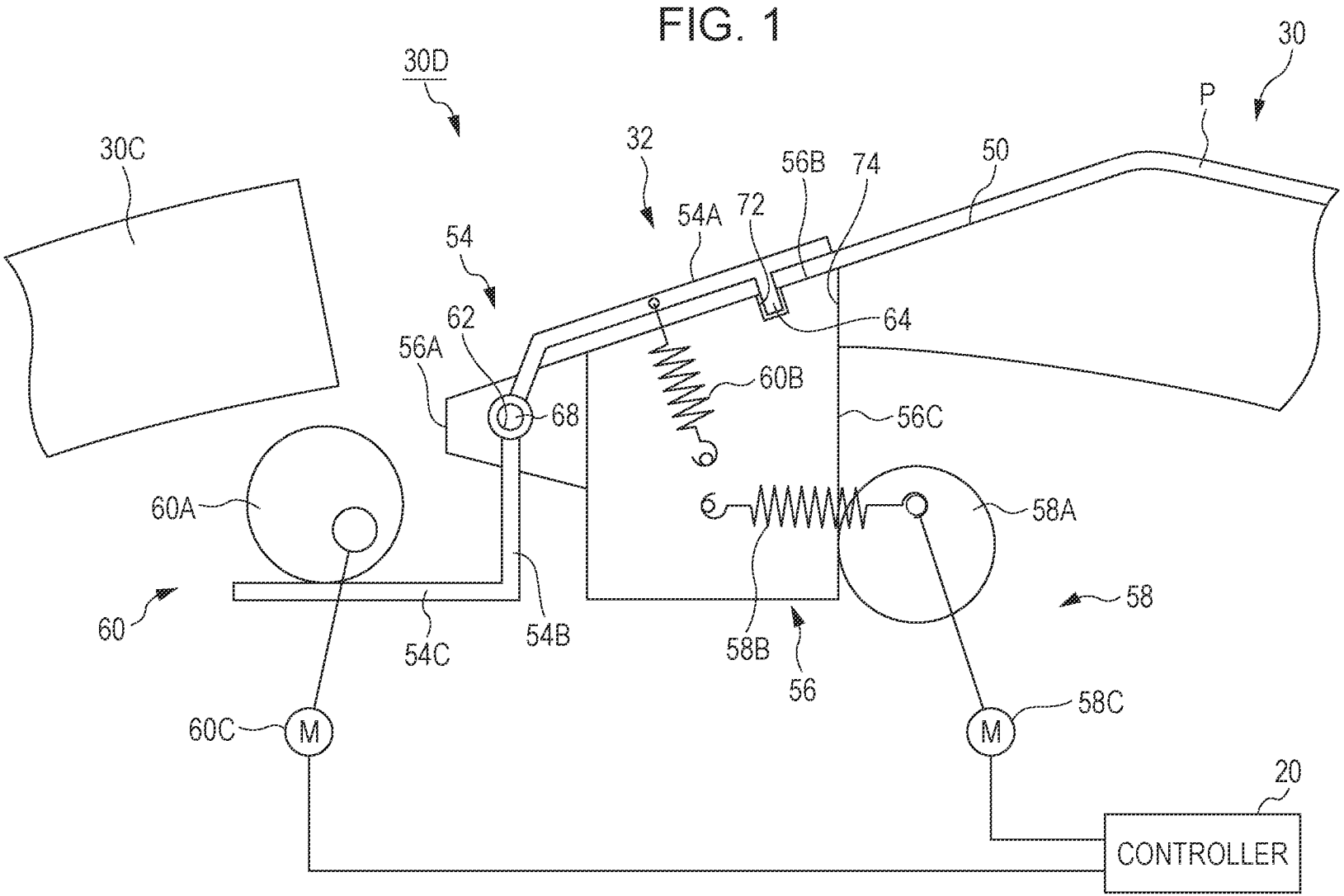
FIG. 1 is an enlarged side view of a leading-end gripper of a transfer device according to a first exemplary embodiment of the invention.

As illustrated in FIG. 1, the leading-end gripper 32 grips a leading-end portion of a sheet medium P that lies along a slope 50 of the elastic layer 30C that faces the cutout region 30D.

The leading-end gripper 32 includes a gripping member 54, which grips or releases a leading-end portion of the sheet medium P by rotating, a base member 56, which supports the gripping member 54 and grips the leading-end portion of the sheet medium P between itself and the gripping member 54, and a gripping-member operating member 60, which rotates the gripping member 54.

The transfer device 14 also includes a base-member operating member 58, which is an example of a moving member that moves the base member 56 of the leading-end gripper 32 in a direction of rotation of the transfer drum 30 (hereinafter also referred to as a "drum rotation direction", simply).

Leading-End Gripper

Gripping Member

The gripping member 54 is formed by bending a board, has a crank shape when seen in a drum axis direction, and extends in the drum axis direction.

The gripping member 54 includes a top board 54A, a radial board 54B, and a bottom board 54C. The top board 54A is formed so as to extend along the slope 50 and grips the leading-end portion of the sheet medium P. An end portion of the top board 54A is connected to an end portion of the radial board 54B. The radial board 54B has a shaft hole 62 into which a shaft member 68 that rotatably supports the gripping member 54 is inserted. The bottom board 54C is connected to another end portion of the radial board 54B and extends in the drum rotation direction.

A projection 64, which protrudes such that the leading-end portion of the sheet medium P gripped by the gripping member 54 abuts against the projection 64, is formed on a surface of the top board 54A that contacts the sheet medium P. In other words, the leading-end portion of the sheet medium P is positioned by being abutted against the projection 64, so that a leading-end-side gripped area of the sheet medium P that is gripped by the top board 54A (or a gripped region) is regulated.

Here, the leading-end-side gripped area is an area on a leading-end side of the sheet medium P that is gripped between the top board 54A and the base member 56 when the leading-end portion of the sheet medium P is gripped by the leading-end gripper 32. In short, the leading-end-side gripped area is an area of a leading-end margin of the sheet medium P in which a toner image is not formable.

Base Member

Figure 2:
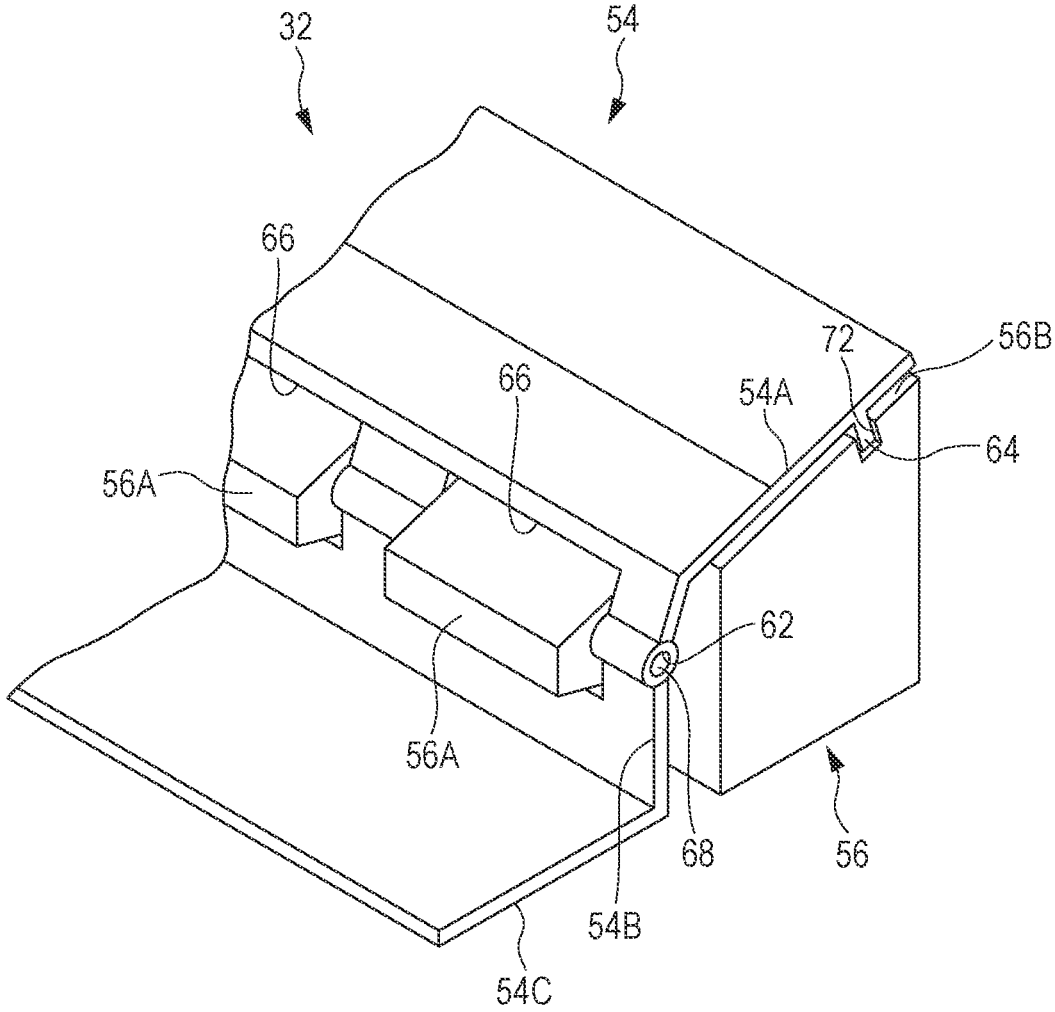
FIG. 2 is a perspective view of the leading-end gripper of the transfer device according to the first exemplary embodiment.

As illustrated in FIGS. 1 and 2, the base member 56 includes insertion portions 56A, which are inserted into openings 66 formed in the radial board 54B of the gripping member 54 and rotatably support the shaft member 68. The base member 56 has an upper surface 56B that grips the sheet medium P between itself and the top board 54A of the gripping member 54. A recess 72 into which the projection 64 is insertable is formed in the upper surface 56B.

An edge of the upper surface 56B is contiguous with a contact surface 56C, which extends in the drum radius direction and part of which contacts an end surface 74 of the elastic layer 30C.

The base member 56 is supported by a supporting member (not illustrated) so as to be movable in the drum rotation direction.

Gripping-Member Operating Member

The gripping-member operating member 60 includes a cam 60A, an urging spring 60B, and a stepping motor 60C (simply referred to as a "motor 60C" below). An outer circumferential surface of the cam 60A contacts the bottom board 54C from the outer side of the bottom board 54C in the drum radius direction. The urging spring 60B urges the bottom board 54C toward the outer circumferential surface of the cam 60A, and the motor 60C rotates the cam 60A.

An end portion of the urging spring 60B is fixed to a side surface of the top board 54A and another end portion of the urging spring 60B is fixed to a side surface of the base member 56.

In this configuration, the gripping member 54 is positioned so as to be in the gripping state (see FIG. 3A), in which the gripping member 54 grips the leading-end portion of the sheet medium P between itself and the base member 56, by using the urging force of the urging spring 60B. When the cam 60A is rotated, the outer circumferential surface of the cam 60A presses the bottom board 54C. Consequently, the gripping member 54 rotates and switches from the gripping state to the releasing state (see FIG. 3C) in which the gripping member 54 releases the leading-end portion of the sheet medium P.

Base-Member Operating Member

The base-member operating member 58 includes a cam 58A, an urging spring 58B, and a stepping motor 58C (simply referred to as a "motor 58C" below). An outer circumferential surface of the cam 58A contacts the contact surface 56C of the base member 56. The urging spring 58B urges the contact surface 56C toward the outer circumferential surface of the cam 58A. The motor 58C rotates the cam 58A.

An end portion of the urging spring 58B is fixed to a rotation shaft of the cam 58A and another end portion of the urging spring 58B is fixed to a side surface of the base member 56.

In this configuration, the base member 56 moves along a guide member (not illustrated) so as to switch between a normal state (see FIG. 3A) and a separate state (see FIG. 3B) by rotating the cam 58A. In the normal state, the contact surface 56C contacts the end surface 74. In the separate state, the contact surface 56C is separated from the end surface 74 as a result of the base member 56 moving downward in the drum rotation direction.

How the controller 20 controls the motor 58C and the motor 60C will be described below together with operations of related portions.

Separating Member

Separating members 69 (see FIG. 3C) that separate the sheet medium P from the transfer drum 30 are disposed at positions that are downstream from the transfer position Tr (see FIG. 11) in the drum rotation direction and that are opposite the transfer drum 30.

Figure 3A:
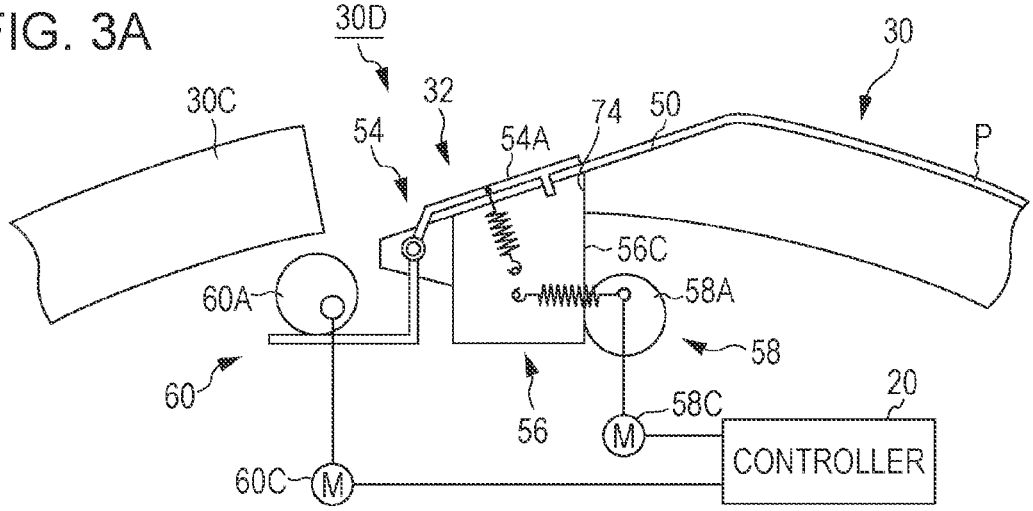
FIGS. 3A, 3B, and 3C are side views that sequentially illustrate the process of switching the leading-end gripper of the transfer device according to the first exemplary embodiment to a releasing state.
Figure 3B:
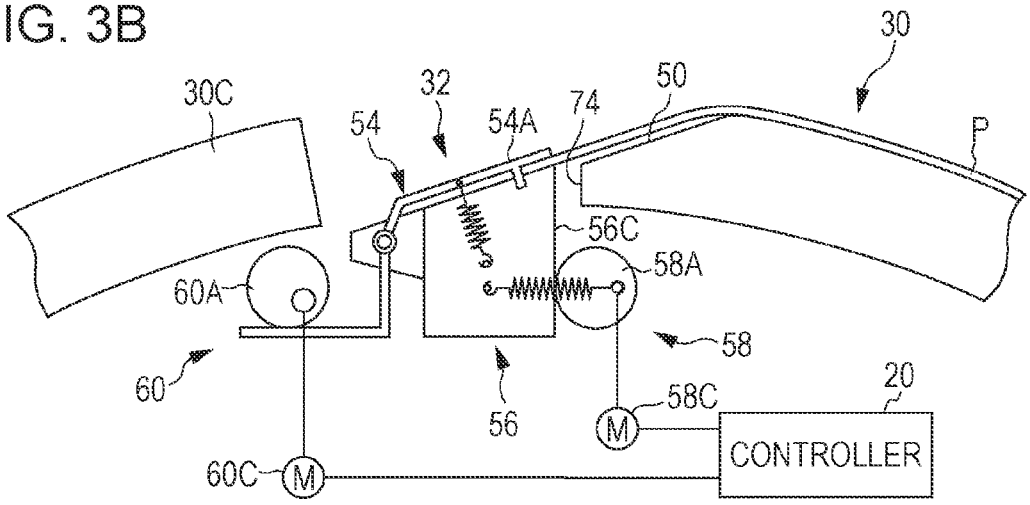
Figure 3C:
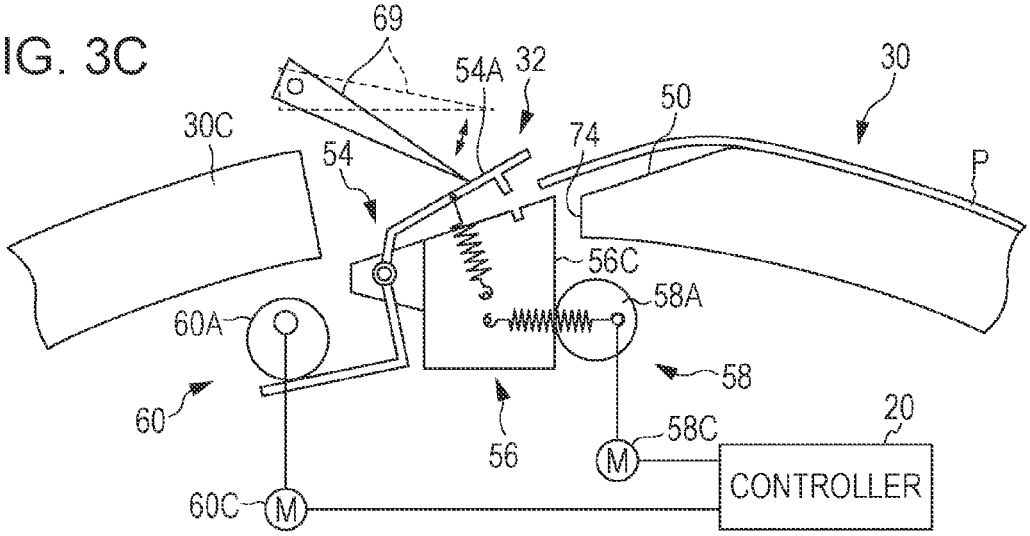
Figure 3D:
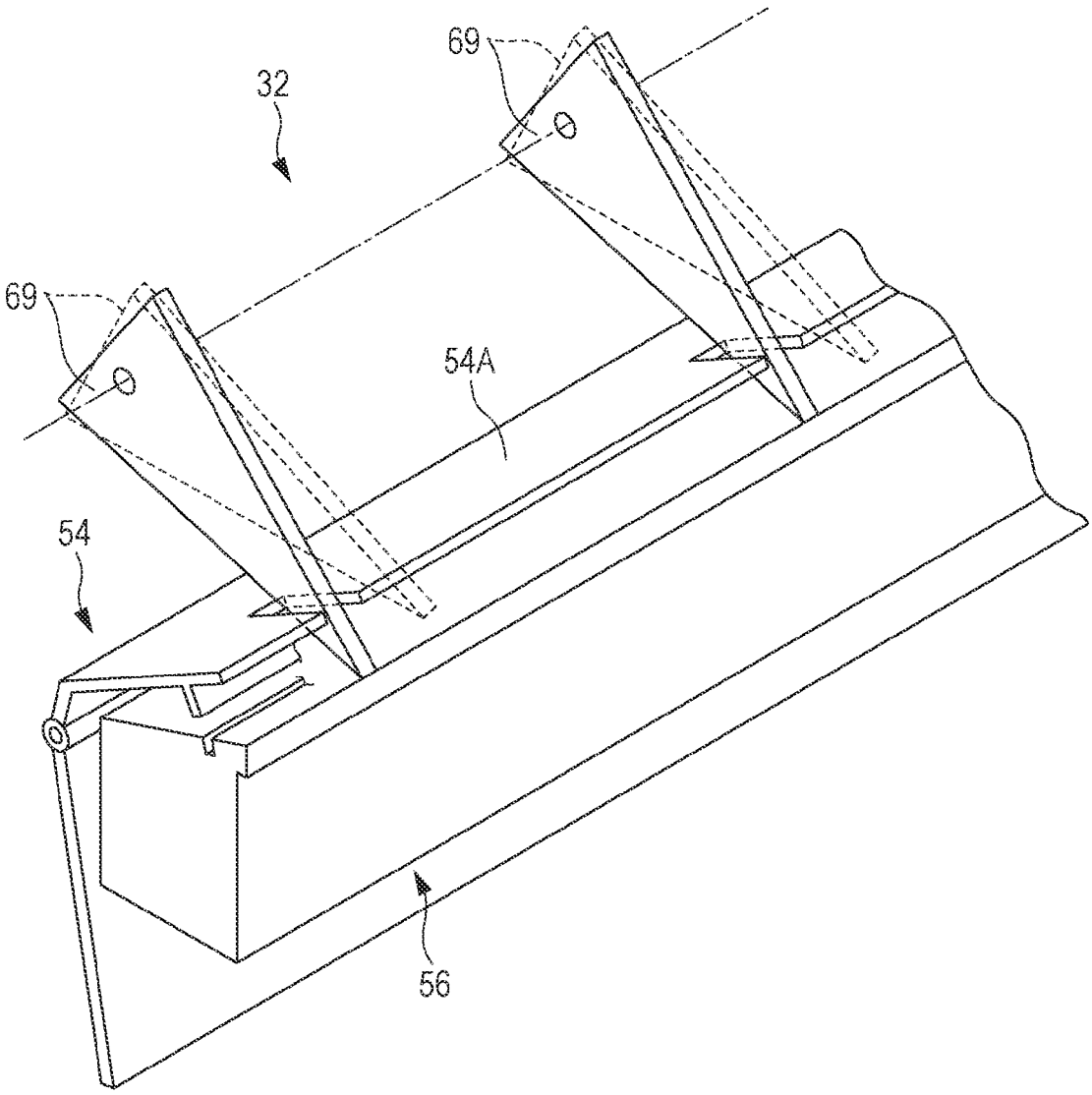
FIG. 3D is a perspective view of components, such as separating members, of the transfer device according to the first exemplary embodiment.

As illustrated in FIG. 3C, each separating member 69 is triangular when seen in the drum axis direction, and has an acute tip end on a sheet-separating side. A solenoid (not illustrated) allows the tip end to move or rotate in the drum radius direction (see FIG. 3D).

In this configuration, separation of a sheet medium P from the transfer drum 30 involves the following steps. In the cutout region 30D, the tip ends of the separating members 69 are rotated so as to be positioned further inward than the outer periphery of the transfer drum 30 (as illustrated with solid lines). As soon as the tip ends come into contact with a leading-end portion of the sheet medium P from the back side of the sheet medium P, the separating members 69 withdraw themselves from the transfer drum 30 back to the original positions (as illustrated with broken lines) to separate the sheet medium P from the transfer drum 30.

Operations of Related Portions

As illustrated in FIG. 4A, gripping of the leading-end portion of a sheet medium P with the leading-end gripper 32 involves the following steps. First, the controller 20 controls the motor 58C such that the cam 58A is rotated to cause the base member 56 to be in the normal state. Then, the controller 20 controls the motor 60C such that the cam 60A is rotated to cause the gripping member 54 to be in the releasing state.

In this state, the leading-end portion of the sheet medium P enters the cutout region 30D at the feeding-sheet position Pa (see FIG. 11) and abuts against the projection 64 of the gripping member 54.

Then, the controller 20 controls the motor 60C such that the cam 60A is rotated to switch the gripping member 54 to the gripping state as illustrated in FIG. 3A. Consequently, the leading-end portion of the sheet medium P is gripped by the leading-end gripper 32.

Separation of the sheet medium P from the transfer drum 30 involves the following steps. First, the controller 20 controls the motor 58C such that the cam 58A is rotated to switch the base member 56 to the separate state as illustrated in FIG. 3B.

Consequently, a leading-end side of the sheet medium P moves away from the end surface 74 of the elastic layer 30C.

Then, the controller 20 controls the motor 60C such that the cam 60A is rotated to switch the gripping member 54 to the releasing state as illustrated in FIG. 3C. Consequently, the leading-end portion of the sheet medium P is released while maintaining a certain distance from the end surface 74 of the elastic layer 30C and thus the sheet medium P becomes separated from the transfer drum 30 by the separating members 69.

By releasing the leading-end portion of the sheet medium P in this manner, an area of the elastic layer 30C on a leading-end side of the sheet medium P over which the elastic layer 30C contacts the separating members 69 increases compared to the case where the gripping member 54 is switched to the releasing state without moving the base member 56.

When an area over which the elastic layer 30C contacts the separating members 69 increases, a sheet medium P that has adhered to the surface of the transfer drum 30 by electrostatic attraction is less likely to slip out of the separating members 69 because of the separating members 69 being damaged by the end surface 74 of the elastic layer 30C or an insufficient amount by which the separating member 69 catches the sheet medium P, thereby suppressing separation failure. In other words, failure to separate the sheet medium P from the transfer drum 30 is suppressed even when a leading-end area (leading-end margin) of the sheet medium P that is gripped by the leading-end gripper 32 is smaller than in the case where the base member 56 is not movable.

By suppressing failure to separate the sheet medium P from the transfer drum 30, the sheet medium P that is transported between the image carrier 22 and the transfer drum 30 becomes less likely to be jammed.

Second Exemplary Embodiment

Referring now to FIG. 12 to FIG. 15, a transfer device 14 and an image forming apparatus 10 according to a second exemplary embodiment of the invention will be described. Components that are the same as those in the first exemplary embodiment are denoted by the same reference symbols and description thereof is not provided.

Figure 12:
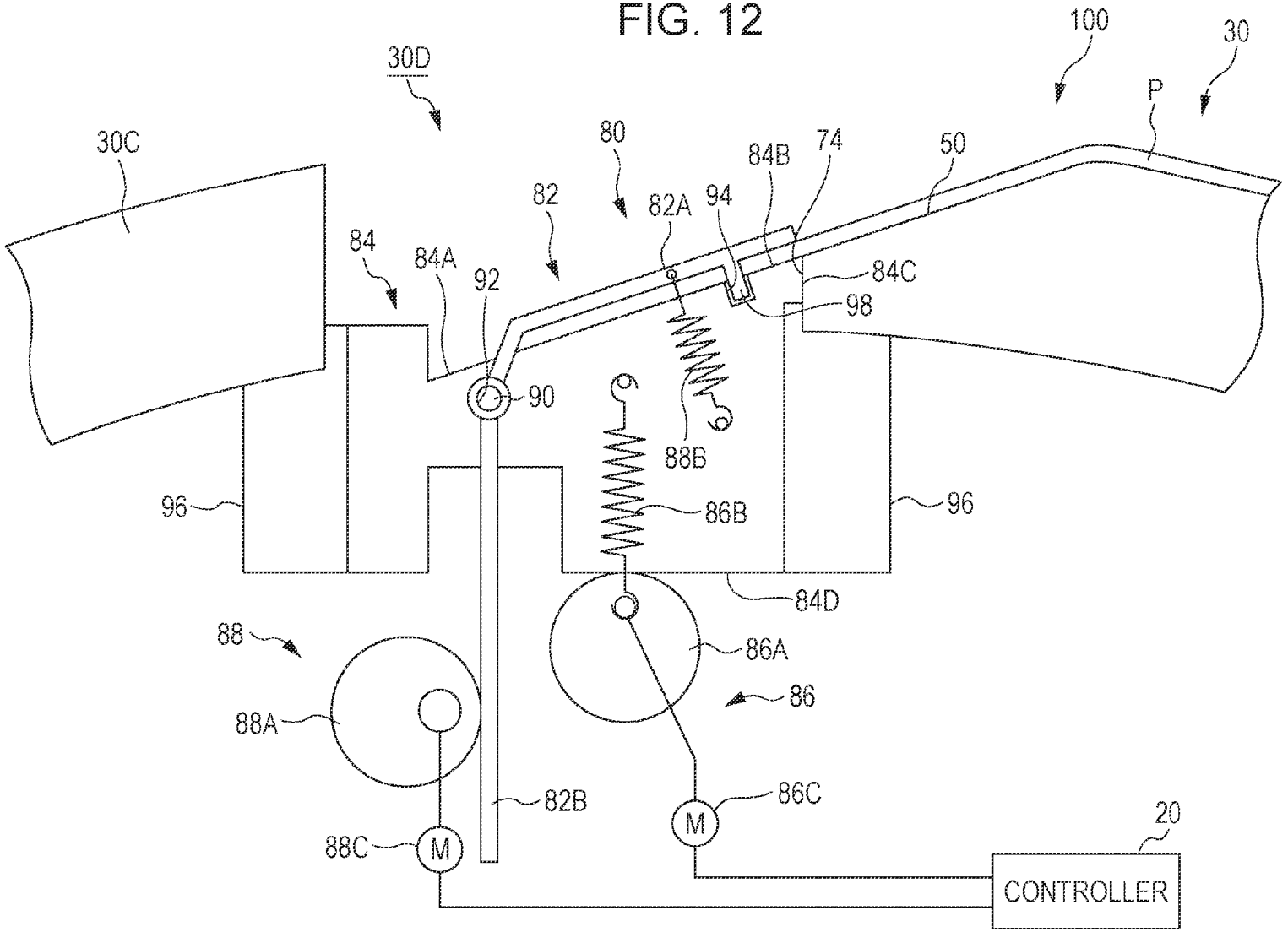
FIG. 12 is an enlarged side view of a leading-end gripper of a transfer device according to a second exemplary embodiment of the invention.

As illustrated in FIG. 12, a leading-end gripper 80, which is an example of a leading-end gripping member of the transfer device 100 according to the second exemplary embodiment, includes a gripping member 82, a base member 84, and a gripping-member operating member 88. The gripping member 82 grips or releases the leading-end portion of the sheet medium P by rotating. The base member 84 supports the gripping member 82 and grips the leading-end portion of the sheet medium P between itself and the gripping member 82. The gripping-member operating member 88 rotates the gripping member 82.

The transfer device 100 also includes a base-member operating member 86, which is an example of a moving member, that moves the base member 84 of the leading-end gripper 80 in the drum radius direction.

The transfer device 100 also has separating members 102 (see FIG. 15) that are inserted between the transfer drum 30 and the leading-end portion of the sheet medium P to separate the sheet medium P from the transfer drum 30.

Leading-End Gripper

Gripping Member

The gripping member 82 is formed by bending a board, has a single bent portion when seen in the drum axis direction, and extends in the drum axis direction.

The gripping member 82 includes a top board 82A and a radial board 82B. The top board 82A is formed so as to be continuous with the slope 50 and grips the leading-end portion of the sheet medium P. An end portion of the top board 82A is connected to an end portion of the radial board 82B. The radial board 82B has a shaft hole 92 into which a shaft member 90 that rotatably supports the gripping member 82 is inserted.

A projection 98, which protrudes such that the leading-end portion of the sheet medium P gripped by the gripping member 82 abuts against the projection 98, is formed on a surface of the top board 82A that contacts the sheet medium P.

Base Member

The base member 84 includes insertion portions 84A, which are inserted into openings (not illustrated) formed in the radial board 82B of the gripping member 82 and rotatably support the shaft member 90. The base member 84 has an upper surface 84B that grips the sheet medium P between itself and the top board 82A of the gripping member 82.

A recess 94 into which the projection 98 is insertable is formed in the upper surface 84B. An edge of the upper surface 84B is contiguous with a contact surface 84C, which extends in the drum radius direction and at least part of which contacts an end surface 74 of the elastic layer 30C. A flat bottom surface 84D that extends in the drum rotation direction lies on the opposite side of the upper surface 84B.

The leading-end gripper 80 includes supporting members 96 that support the base member 84 such that the base member 84 is movable in the drum radius direction.

Gripping-Member Operating Member

The gripping-member operating member 88 includes a cam 88A, an urging spring 88B, and a stepping motor 88C (simply referred to as a "motor 88C" below). An outer circumferential surface of the cam 88A contacts the radial board 82B on the downstream side of the radial board 82B in the drum rotation direction. The urging spring 88B urges the radial board 82B toward the outer circumferential surface of the cam 88A, and the motor 88C rotates the cam 88A.

An end portion of the urging spring 88B is fixed to a side surface of the top board 82A and another end portion of the urging spring 88B is fixed to a side surface of the base member 84.

In this configuration, by rotating the cam 88A, the gripping member 82 switches between a gripping state (see FIG. 13A), in which the gripping member 82 grips the leading-end portion of the sheet medium P between itself and the base member 84, and a releasing state (see FIG. 14A), in which the griping member 82 releases the leading-end portion of the sheet medium P.

Base-Member Operating Member

The base-member operating member 86 includes a cam 86A, an urging spring 86B, and a stepping motor 86C (simply referred to as a "motor 86C" below). An outer circumferential surface of the cam 86A contacts the bottom surface 84D of the base member 84. The urging spring 86B urges the bottom surface 84D toward the outer circumferential surface of the cam 86A. The motor 86C rotates the cam 86A.

An end portion of the urging spring 86B is fixed to a rotation shaft of the cam 86A and another end portion of the urging spring 86B is fixed to a side surface of the base member 84.

In this configuration, the base member 84 switches between a normal state (see FIG. 13A) and a projecting state (see FIG. 13B) by rotating the cam 86A. In the normal state, the upper surface 84B is positioned so as to be continuous with and flush with the slope 50. In the projecting state, the upper surface 84B protrudes above the slope 50 as a result of the base member 84 moving outward in the drum radius direction.

How the controller 20 controls the motor 86C and the motor 88C will be described below together with operations of related portions.

Separating Member

Separating members 102 (see FIG. 15) that separate the sheet medium P from the transfer drum 30 are disposed at positions that are downstream from the transfer position Tr (see FIG. 11) in the drum rotation direction and that are opposite the transfer drum 30.

Figure 14A:
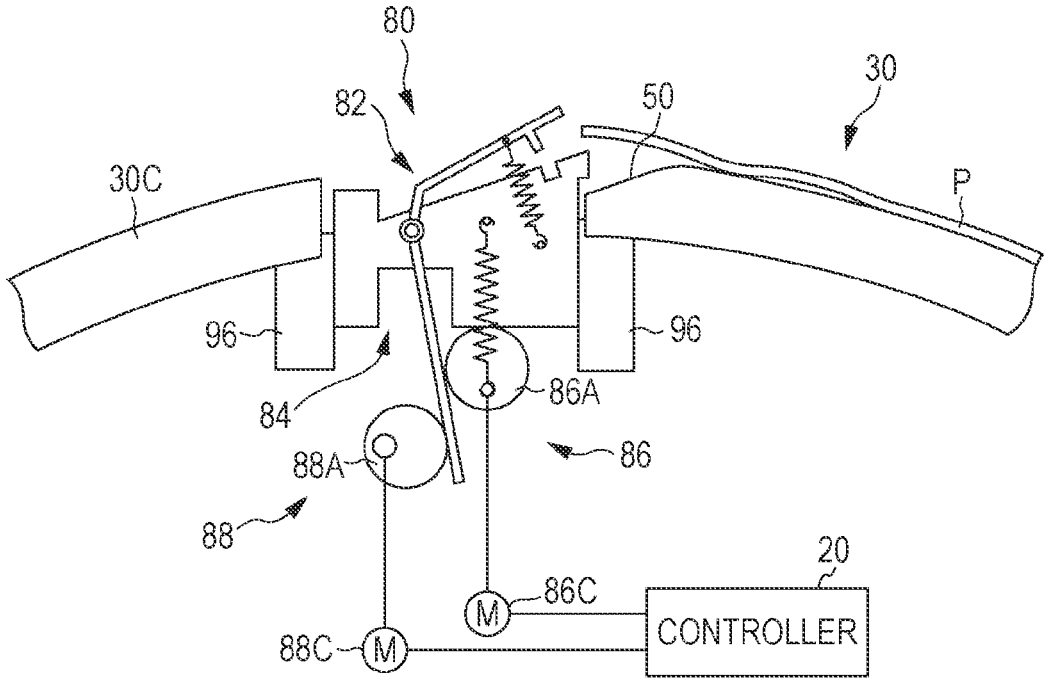
FIGS. 14A and 14B are side views that sequentially illustrate the process of switching the leading-end gripper of the transfer device according to the second exemplary embodiment to a releasing state.
Figure 14B:
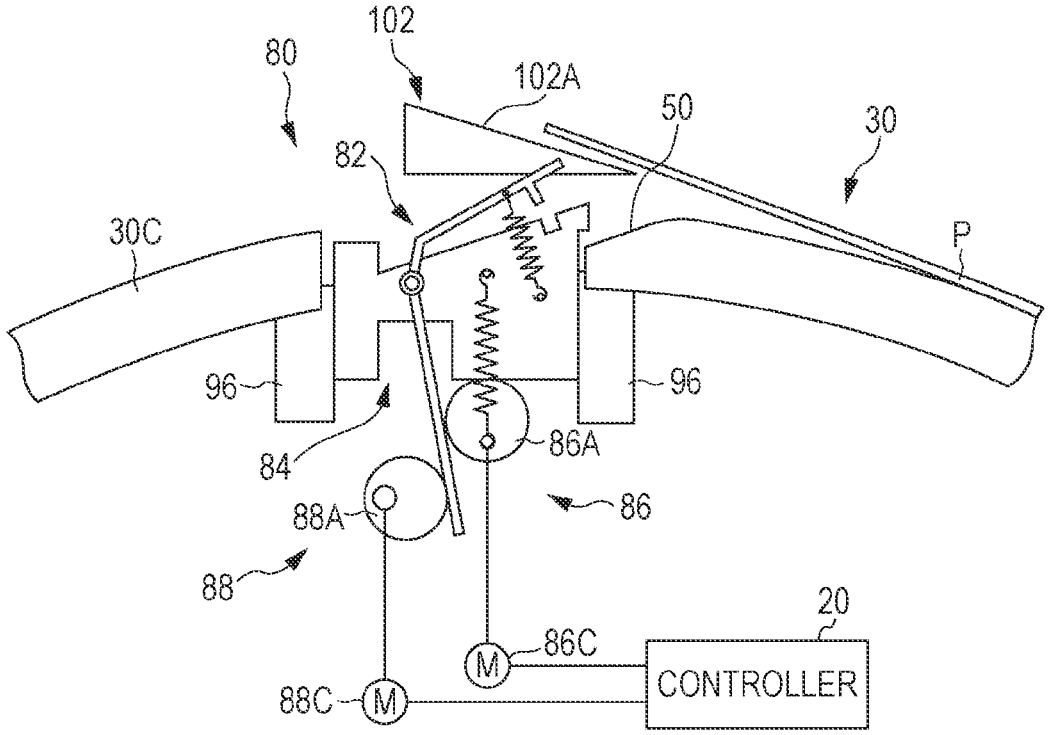
Figure 15:
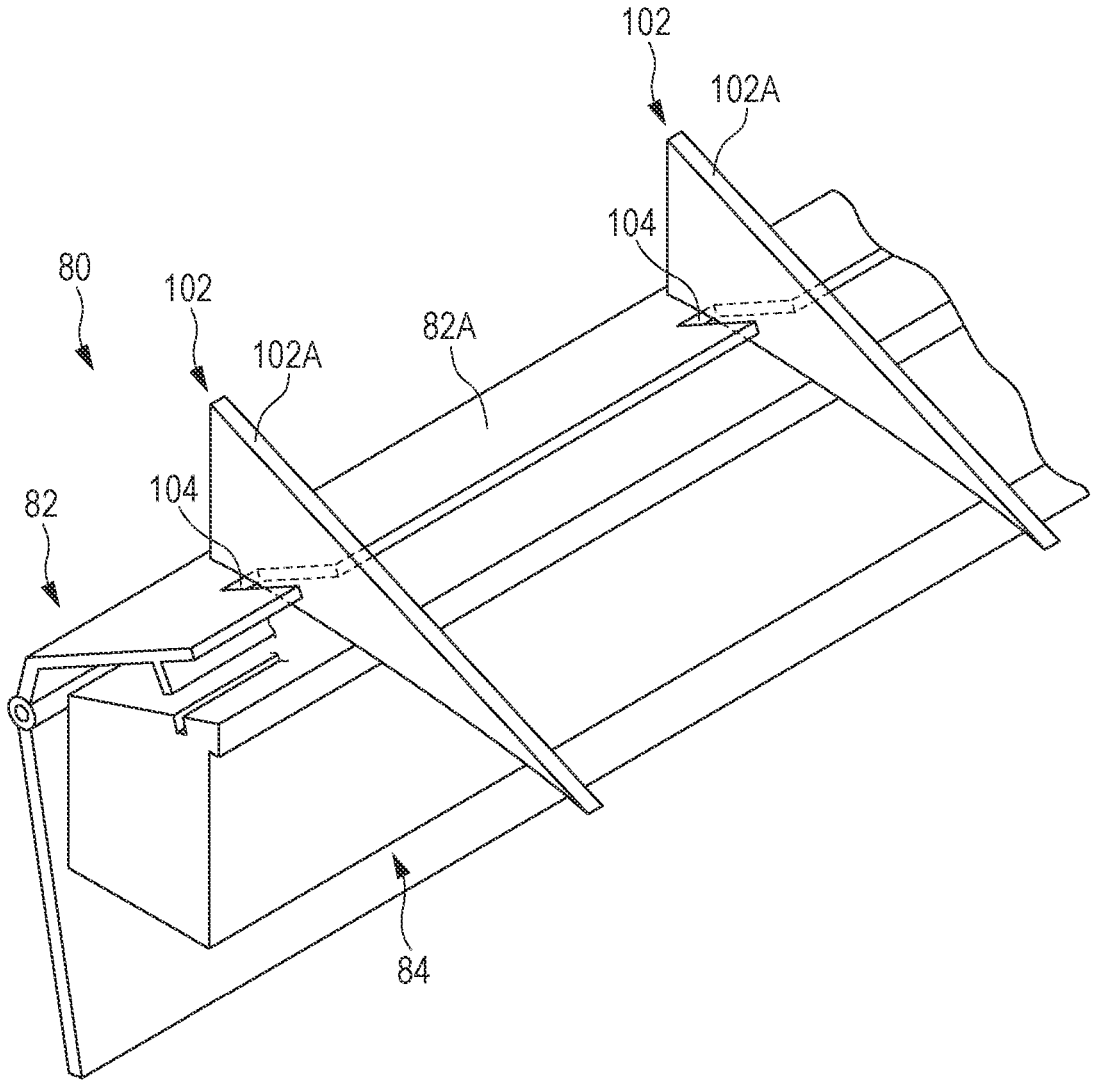
FIG. 15 is a perspective view of the leading-end gripper of the transfer device according to the second exemplary embodiment.

As illustrated in FIGS. 14B and 15, the separating members 102 each have a separating surface 102A that is straight when seen in the drum axis direction. The separating members 102 have a plate shape and are arranged at certain intervals in the drum axis direction. When the leading-end gripper 32 that is in the releasing state passes the position opposite the separating members 102, the separating members 102 are caused to pass through recesses 104 formed in the top board 82A of the gripping member 82.

Operations of Related Portions

Gripping of the leading-end portion of the sheet medium P involves the following steps. First, the leading-end portion of the sheet medium P enters the cutout region 30D at the feeding-sheet position Pa (see FIG. 11) and abuts against the projection 98 of the gripping member 82.

Figure 13A:
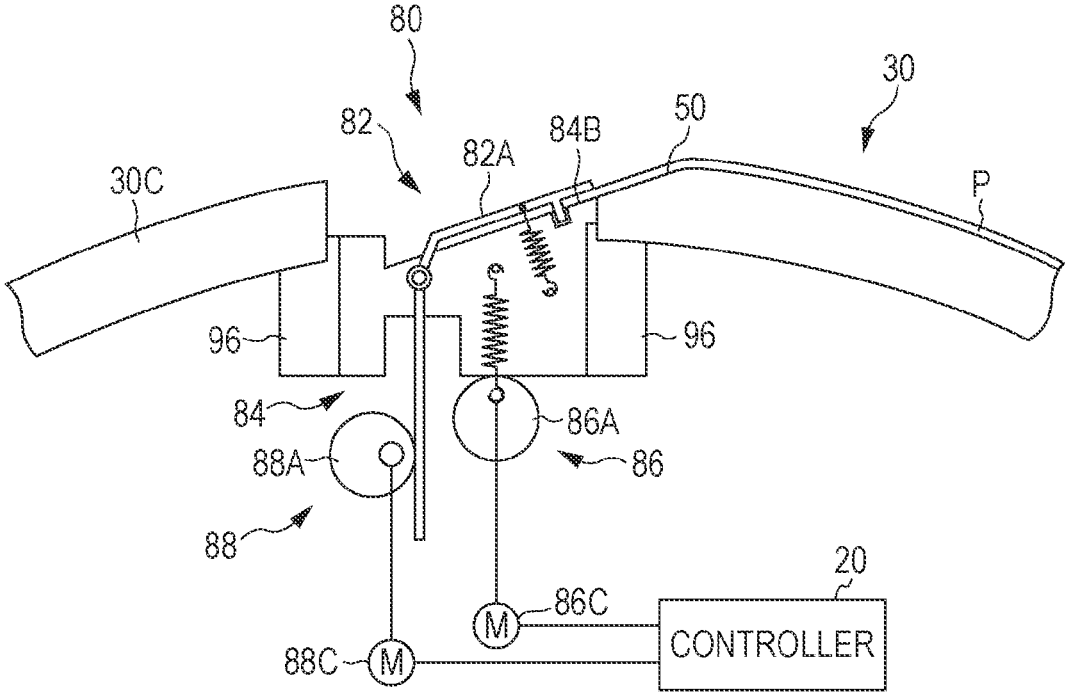
FIGS. 13A and 13B are side views that sequentially illustrate the process of switching the leading-end gripper of the transfer device according to the second exemplary embodiment to a releasing state.

Then, the controller 20 controls the motor 88C such that the cam 88A is rotated to switch the gripping member 82 from the releasing state to the gripping state as illustrated in FIG. 13A. Consequently, the leading-end portion of the sheet medium P is gripped by the leading-end gripper 80.

Figure 13B:
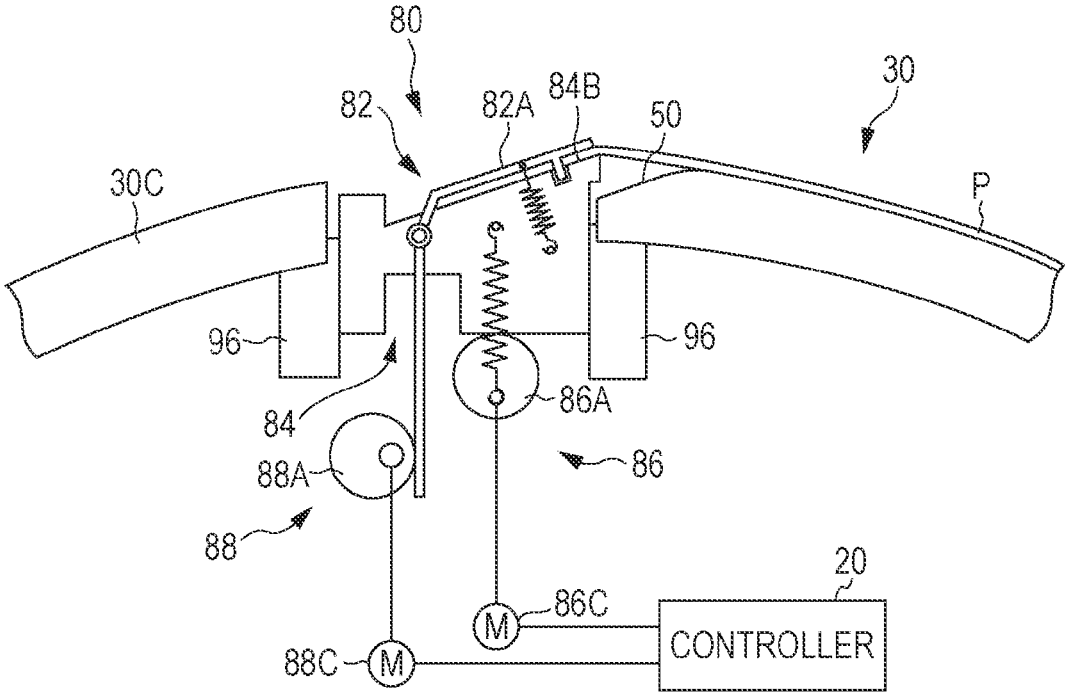

Separation of the sheet medium P from the transfer drum 30 involves the following steps. First, the controller 20 controls the motor 86C such that the cam 86A is rotated to switch the base member 84 from the normal state to the projecting state as illustrated in FIG. 13B.

Consequently, a leading-end side of the sheet medium P becomes separated from the slope 50 of the elastic layer 30C.

Then, the controller 20 controls the motor 88C such that the cam 88A is rotated to switch the gripping member 82 to the releasing state as illustrated in FIG. 14A.

As the transfer drum 30 rotates further and the leading-end portion of the sheet medium P passes the position opposite the separating members 102 as illustrated in FIG. 14B, the separating surfaces 102A of the separating members 102 come into contact with the sheet medium P from the leading end of the sheet medium P, and thus the sheet medium P becomes separated from the transfer drum 30.

As described above, the base-member operating member 86 moves the base member 84 in the drum radius direction. This increases an area of the leading-end portion of the sheet medium P that is separated from the elastic layer 30C compared to the case where the base member is not movable.

In addition, separation of the sheet medium P from the transfer drum 30 is performed more effectively since the separating members 102 are used to separate the sheet medium P from the transfer drum 30. Other operations are the same as those in the first exemplary embodiment.

Third Exemplary Embodiment

Figure 16A:
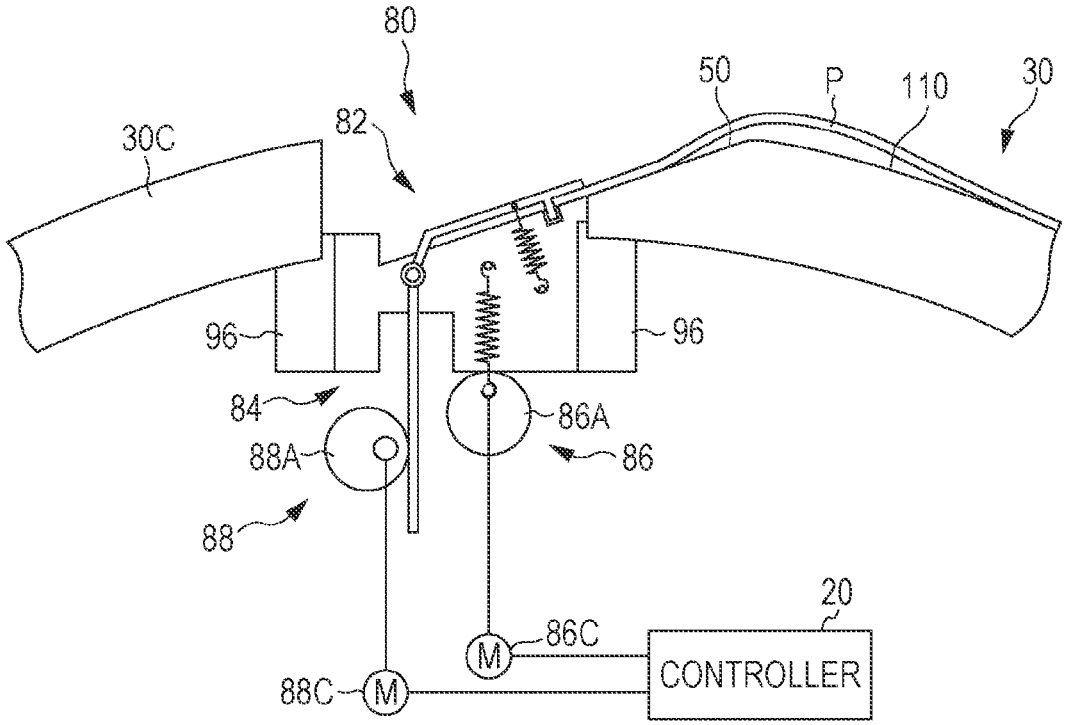
FIGS. 16A and 16B are side views that sequentially illustrate the process of switching the leading-end gripper of the transfer device according to the third exemplary embodiment to a releasing state.
Figure 16B:
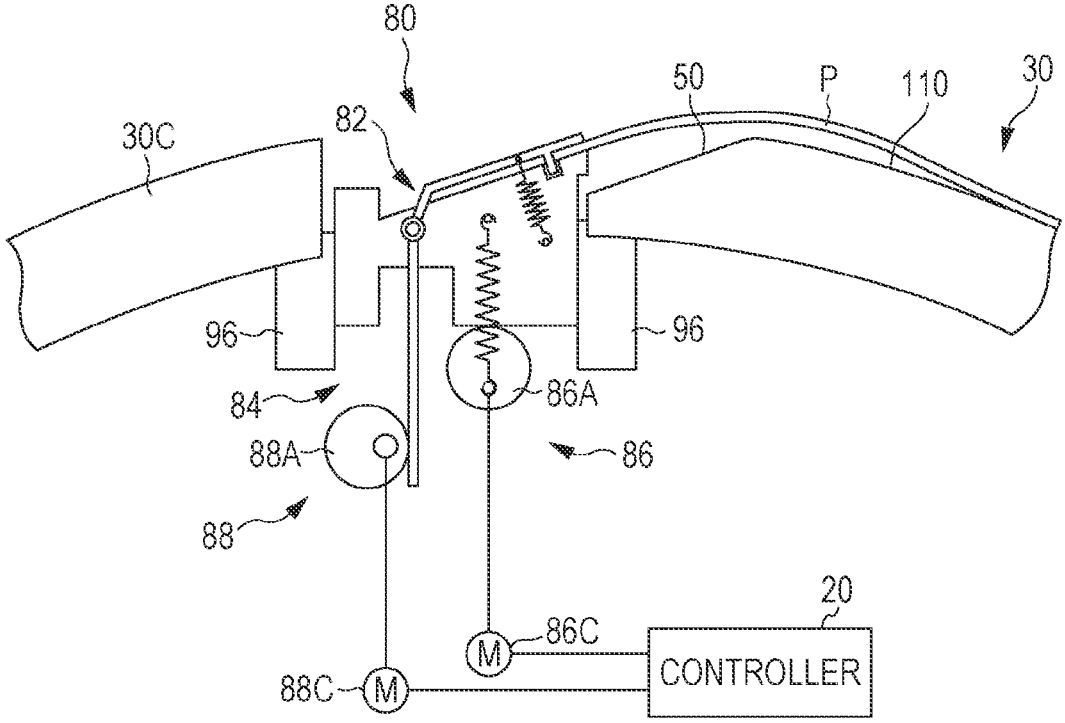

Referring to FIGS. 16A and 16B, a transfer device 14 and an image forming apparatus 19 according to a third exemplary embodiment of the invention will be described. Components that are the same as those in the second exemplary embodiment will be denoted by the same reference symbols and description thereof is not provided.

A controller 20 according to the third exemplary embodiment controls driving members that rotate the image carrier 22 and the transfer drum 30 such that the image carrier 22 rotates at a higher peripheral velocity than the transfer drum 30 at least when the leading-end gripper 80 releases the leading-end portion of the sheet medium P. In this exemplary embodiment, the image carrier 22 constantly rotates at a higher peripheral velocity than the transfer drum 30.

Specifically, the controller 20 controls the driving motor 22B (see FIG. 10), which rotates the image carrier 22, and the driving motor M1 (see FIGS. 7A and 7B), which rotates the transfer drum 30.

With this control, the sheet medium P is lifted in the vicinity of the boundary between a base-level surface 110 and the slope 50 of the elastic layer 30C so as to become separated from the elastic layer 30C and sagged when the leading-end gripper 80 releases the leading-end portion of the sheet medium P as illustrated in FIG. 16A.

In addition, the controller 20 controls the motor 86C such that the cam 86A is rotated to switch the base member 84 from the normal state to the projecting state as illustrated in FIG. 16B.

By rotating the image carrier 22 at a higher peripheral velocity than the transfer drum 30 in this manner, variance in velocity of the sheet medium P during sheet separation no longer affects the image quality during image transfer unlike in the case where the image carrier 22 rotates at the same peripheral velocity as the transfer drum 30. Accordingly, the sheet medium P is effectively separated from the transfer drum 30. Other operations are the same as those in the second exemplary embodiment.

Although the present invention has been described in detail on the basis of specific exemplary embodiments, it is obvious to those skilled in the art that the present invention is not limited to the exemplary embodiments and that various other exemplary embodiments may be made within the scope of the invention. Although not described, in the first exemplary embodiment, the image carrier may rotate at a higher peripheral velocity than the transfer drum when the leading-end gripper releases the leading-end portion of the sheet medium P, for example, as in the case of the third exemplary embodiment. With this setting of velocities, the sheet medium P is effectively separated from the transfer drum.

Although the base member is moved in the drum rotation direction or the drum radius direction in the exemplary embodiments, the base member may be moved in a direction that is inclined toward the drum radius direction when seen in the drum axis direction.

In the first exemplary embodiment, the base member 56 is moved in the drum rotation direction to be disposed downstream in the drum rotation direction. In other words, the base member 56 is moved so as to draw an arc. However, the base member 56 may be moved along a straight line to be disposed downstream in the drum rotation direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transfer body around whose outer circumferential surface a recording medium is wrapped, the transfer body transporting the recording medium to a transfer position, at which the transfer body faces an image carrier on whose surface toner images are sequentially formed while the image carrier rotates, a plurality of times in order to sequentially transfer the toner images formed on the surface of the image carrier to the recording medium;

a leading-end gripping member that is disposed at a recess formed in the outer circumferential surface of the transfer body, the leading-end gripping member gripping a leading-end portion of the recording medium when causing the recording medium to be wrapped around the transfer body, the leading-end gripping member releasing the leading-end portion of the recording medium when causing the recording medium that has been wrapped around the transfer body to become separated from the transfer body; and a moving member that moves, after a final toner image starts being transferred to the recording medium but before the leading-end gripping member releases the leading-end portion of the recording medium, the leading-end gripping member while the leading-end gripping member grips the leading-end portion of the recording medium in order to cause a leading-end side of the recording medium to become separated from the outer circumferential surface of the transfer body.

2. The transfer device according to claim 1, wherein the moving member moves the leading-end gripping member downstream in a direction of rotation of the transfer body.

3. The transfer device according to claim 1, wherein the moving member moves the leading-end gripping member outward in a radial direction of the transfer body.

4. An image forming apparatus comprising:

an image carrier on whose surface toner images are sequentially formed while the image carrier rotates; and the transfer device according to claim 1 that sequentially transfers the toner images formed on the image carrier to a recording medium.

5. The image forming apparatus according to claim 4, further comprising:

a controller that controls a driving member rotating the image carrier and a driving member rotating the transfer body such that a peripheral velocity of the image carrier becomes higher than a peripheral velocity of the transfer body at least when the leading-end gripping member moves to release the leading-end portion of the recording medium.

* * * * *